US010226687B2

(12) United States Patent
Grauzer et al.

(10) Patent No.: US 10,226,687 B2
(45) **Date of Patent: *Mar. 12, 2019**

(54) METHOD AND APPARATUS FOR USING UPSTREAM COMMUNICATION IN A CARD SHUFFLER

(71) Applicant: Bally Gaming, Inc., Las Vegas, NV (US)

(72) Inventors: Attila Grauzer, Las Vegas, NV (US); David B. Lopez, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/242,064

(22) Filed: Aug. 19, 2016

(65) Prior Publication Data

US 2016/0354678 A1 Dec. 8, 2016

Related U.S. Application Data

(60) Division of application No. 13/719,059, filed on Dec. 18, 2012, now Pat. No. 9,452,346, which is a (Continued)

(51) Int. Cl.
*A63F 1/12* (2006.01)
*A63F 1/06* (2006.01)
(Continued)

(52) U.S. Cl.
CPC ..... *A63F 1/12* (2013.01); *A63F 1/06* (2013.01); *A63F 1/067* (2013.01); *A63F 1/10* (2013.01);
(Continued)

(58) Field of Classification Search
None
See application file for complete search history.

(56) References Cited

U.S. PATENT DOCUMENTS 130,281 A 8/1872 Coughlik
205,030 A 6/1878 Ash
(Continued)

FOREIGN PATENT DOCUMENTS

AU 2383667 A 1/1969
AU 5025479 A 3/1980
(Continued)

OTHER PUBLICATIONS

"ACE, Single Deck Shuffler," Shuffle Master, Inc., (2005), 2 pages.
(Continued)

*Primary Examiner* — Robert T Clarke, Jr.
(74) *Attorney, Agent, or Firm* — TraskBritt

(57) ABSTRACT

A security system for a casino table card game has a casino table with i) indicia thereon for the placement of wagers, ii) a data entry system with an associated computer, and iii) sensors that can detect the placement of at least one specific category of wager; a shuffling device with a microprocessor integral to the shuffler for providing information regarding cards or hands; a central table gaming computer that receives information from the shuffler in real time, receives information from the sensors, and receives information from the data entry system, the associated computer, the microprocessor and the central table gaming computer communicating data among each other in real time.

19 Claims, 3 Drawing Sheets

Related U.S. Application Data continuation of application No. 09/967,500, filed on Sep. 28, 2001, now Pat. No. 8,337,296.

(51) Int. Cl.

| | |
|---|---|
| ***G07F 17/32*** | (2006.01) |
| ***A63F 1/14*** | (2006.01) |
| ***A63F 1/10*** | (2006.01) |
| ***A63F 1/18*** | (2006.01) |

(52) U.S. Cl.

CPC ..... *A63F 1/14* (2013.01); *A63F 1/18* (2013.01); *G07F 17/32* (2013.01); *G07F 17/322* (2013.01); *G07F 17/3211* (2013.01); *G07F 17/3225* (2013.01); *G07F 17/3227* (2013.01); *G07F 17/3241* (2013.01); *G07F 17/3258* (2013.01); *G07F 17/3293* (2013.01); *A63F 2250/58* (2013.01); *G07F 17/3216* (2013.01)

(56) References Cited

U.S. PATENT DOCUMENTS

| | | | |
|---|---|---|---|
| 609,730 | A | 8/1898 | Booth |
| 673,154 | A | 4/1901 | Bellows |
| 793,489 | A | 6/1905 | Williams |
| 892,389 | A | 7/1908 | Bellows |
| 1,014,219 | A | 1/1912 | Hall |
| 1,043,109 | A | 11/1912 | Hurm |
| 1,157,898 | A | 10/1915 | Perret |
| 1,256,509 | A | 2/1918 | Belknap |
| 1,380,898 | A | 6/1921 | Hall |
| 1,556,856 | A | 10/1925 | Lipps |
| 1,757,553 | A | 5/1930 | Tauschek |
| 1,850,114 | A | 3/1932 | McCaddin |
| 1,885,276 | A | 11/1932 | McKay |
| 1,889,729 | A | 11/1932 | Hammond |
| 1,955,926 | A | 4/1934 | Matthaey |
| 1,992,085 | A | 2/1935 | McKay |
| 1,998,690 | A | 4/1935 | Hartridge et al. |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,060,096 | A | 11/1936 | McCoy |
| 2,065,824 | A | 12/1936 | Plass |
| 2,159,958 | A | 5/1939 | Sachs |
| 2,185,474 | A | 1/1940 | Nott |
| 2,254,484 | A | 9/1941 | Hutchins |
| D132,360 | S | 5/1942 | Gardner |
| 2,328,153 | A | 8/1943 | Laing |
| 2,328,879 | A | 9/1943 | Isaacson |
| D139,530 | S | 11/1944 | Schindler |
| 2,364,413 | A | 12/1944 | Wittel |
| 2,525,305 | A | 10/1950 | Eugene |
| 2,543,522 | A | 2/1951 | Cohen |
| 2,588,582 | A | 3/1952 | Sivertson |
| 2,615,719 | A | 10/1952 | Fonken |
| 2,659,607 | A | 11/1953 | Skillman et al. |
| 2,661,215 | A | 12/1953 | Stevens |
| 2,676,020 | A | 4/1954 | Ogden |
| 2,692,777 | A | 10/1954 | Miller |
| 2,701,720 | A | 2/1955 | Ogden |
| 2,705,638 | A | 4/1955 | Newcomb |
| 2,711,319 | A | 6/1955 | Morgan et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,731,271 | A | 1/1956 | Brown |
| 2,747,877 | A | 5/1956 | Howard |
| 2,755,090 | A | 7/1956 | Aldrich |
| 2,757,005 | A | 7/1956 | Nothaft |
| 2,760,779 | A | 8/1956 | Ogden et al. |
| 2,770,459 | A | 11/1956 | Wilson et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Gottlieb |
| 2,815,214 | A | 12/1957 | Hall |
| 2,821,399 | A | 1/1958 | Lauri |
| 2,914,215 | A | 11/1959 | Neidig |
| 2,937,739 | A | 5/1960 | Levy |
| 2,950,005 | A | 8/1960 | MacDonald |
| RE24,986 | E | 1/1961 | Stephenson |
| 3,067,885 | A | 12/1962 | Kohler |
| 3,107,096 | A | 10/1963 | Osborn |
| 3,124,674 | A | 3/1964 | Edwards et al. |
| 3,131,935 | A | 5/1964 | Gronneberg |
| 3,147,978 | A | 9/1964 | Sjostrand |
| D200,652 | S | 3/1965 | Fisk |
| 3,222,071 | A | 12/1965 | Lang |
| 3,235,741 | A | 2/1966 | Plaisance |
| 3,288,308 | A | 11/1966 | Gingher |
| 3,305,237 | A | 2/1967 | Granius |
| 3,312,473 | A | 4/1967 | Friedman et al. |
| 3,452,509 | A | 7/1969 | Hauer |
| 3,530,968 | A | 9/1970 | Palmer |
| 3,588,116 | A | 6/1971 | Miura |
| 3,589,730 | A | 6/1971 | Slay |
| 3,595,388 | A | 7/1971 | Castaldi |
| 3,597,076 | A | 8/1971 | Hubbard |
| 3,598,396 | A | 8/1971 | Andrews et al. |
| 3,618,933 | A | 11/1971 | Roggenstein |
| 3,627,331 | A | 12/1971 | Erickson |
| 3,666,270 | A | 5/1972 | Mazur |
| 3,680,853 | A | 8/1972 | Houghton |
| 3,690,670 | A | 9/1972 | Cassady et al. |
| 3,704,938 | A | 12/1972 | Fanselow |
| 3,716,238 | A | 2/1973 | Porter |
| 3,751,041 | A | 8/1973 | Seifert |
| 3,761,079 | A | 9/1973 | Azure |
| 3,810,627 | A | 5/1974 | Levy |
| D232,953 | S | 9/1974 | Oguchi |
| 3,861,261 | A | 1/1975 | Maxey |
| 3,897,954 | A | 8/1975 | Erickson et al. |
| 3,899,178 | A | 8/1975 | Watanabe et al. |
| 3,909,002 | A | 9/1975 | Levy |
| 3,929,339 | A | 12/1975 | Mattioli et al. |
| 3,944,077 | A | 3/1976 | Green |
| 3,944,230 | A | 3/1976 | Fineman |
| 3,949,219 | A | 4/1976 | Crouse |
| 3,968,364 | A | 7/1976 | Miller |
| 4,023,705 | A | 5/1977 | Reiner et al. |
| 4,033,590 | A | 7/1977 | Pic |
| 4,072,930 | A | 2/1978 | Lucero et al. |
| 4,088,265 | A | 5/1978 | Garczynski et al. |
| 4,151,410 | A | 4/1979 | McMillan et al. |
| 4,159,581 | A | 7/1979 | Lichtenberg |
| 4,162,649 | A | 7/1979 | Thornton |
| 4,166,615 | A | 9/1979 | Noguchi et al. |
| 4,232,861 | A | 11/1980 | Maul |
| 4,280,690 | A | 7/1981 | Hill |
| 4,283,709 | A | 8/1981 | Lucero et al. |
| 4,310,160 | A | 1/1982 | Willette |
| 4,339,134 | A | 7/1982 | Macheel |
| 4,339,798 | A | 7/1982 | Hedges et al. |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,377,285 | A | 3/1983 | Kadlic |
| 4,385,827 | A | 5/1983 | Naramore |
| 4,388,994 | A | 6/1983 | Suda et al. |
| 4,397,469 | A | 8/1983 | Carter |
| 4,421,312 | A | 12/1983 | Delgado et al. |
| 4,421,501 | A | 12/1983 | Scheffer |
| D273,962 | S | 5/1984 | Fromm |
| D274,069 | S | 5/1984 | Fromm |
| 4,467,424 | A | 8/1984 | Hedges et al. |
| 4,494,197 | A | 1/1985 | Troy et al. |
| 4,497,488 | A | 2/1985 | Plevyak et al. |
| 4,512,580 | A | 4/1985 | Matviak |

(56) References Cited

U.S. PATENT DOCUMENTS 4,513,969 A 4/1985 Samsel
4,515,367 A 5/1985 Howard
4,531,187 A 7/1985 Uhland et al.
4,534,562 A 8/1985 Cuff et al.
4,549,738 A 10/1985 Greitzer
4,566,782 A 1/1986 Britt et al.
4,575,367 A 3/1986 Karmel
4,586,712 A 5/1986 Lorber et al.
4,659,082 A 4/1987 Greenberg
4,662,637 A 5/1987 Pfeiffer et al.
4,662,816 A 5/1987 Fabrig
4,667,959 A 5/1987 Pfeiffer et al.
4,741,524 A 5/1988 Bromage
4,750,743 A 6/1988 Nicoletti
4,755,941 A 7/1988 Bacchi
4,759,448 A 7/1988 Kawabata
4,770,412 A 9/1988 Wolfe
4,770,421 A 9/1988 Hoffman
4,807,884 A 2/1989 Breeding
4,822,050 A 4/1989 Normand et al.
4,832,342 A 5/1989 Plevyak
4,858,000 A 8/1989 Lu
4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.
4,926,327 A 5/1990 Sidley
4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng et al.
5,000,453 A 3/1991 Stevens et al.
5,004,218 A 4/1991 Sardano et al.
5,039,102 A 8/1991 Miller et al.
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci et al.
5,121,192 A 6/1992 Kazui
5,121,921 A 6/1992 Friedman
5,146,346 A 9/1992 Knoll
5,154,429 A 10/1992 Levasseur et al.
5,179,517 A 1/1993 Sarbin et al.
5,197,094 A 3/1993 Tillery et al.
5,199,710 A 4/1993 Lamle
5,209,476 A 5/1993 Eiba et al.
5,224,712 A 7/1993 Laughlin et al.
5,240,140 A 8/1993 Huen
5,248,142 A 9/1993 Breeding et al.
5,257,179 A 10/1993 Demar et al.
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding et al.
5,299,089 A 3/1994 Lwee et al.
5,303,921 A 4/1994 Breeding
5,344,146 A 9/1994 Lee
5,356,145 A 10/1994 Verschoor
5,362,053 A 11/1994 Miller et al.
5,374,061 A 12/1994 Albrecht et al.
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias et al.
5,416,308 A 5/1995 Hood et al.
5,431,399 A 7/1995 Kelley et al.
5,431,407 A 7/1995 Hofberg et al.
5,437,462 A 8/1995 Breeding et al.
5,445,377 A 8/1995 Steinbach
5,470,079 A 11/1995 LeStrange et al.
D365,853 S 1/1996 Zadro
5,489,101 A 2/1996 Moody et al.
5,515,477 A 5/1996 Sutherland
5,524,888 A 6/1996 Heidel
5,531,448 A 7/1996 Moody et al.
5,544,892 A 8/1996 Breeding et al.
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea et al.
5,613,912 A 3/1997 Slater et al.
5,632,483 A 5/1997 Garczynski et al.
5,636,843 A 6/1997 Roberts et al.
5,651,548 A 7/1997 French et al.
5,655,961 A 8/1997 Acres et al.
5,655,966 A 8/1997 Werdin, Jr. et al.
5,669,816 A 9/1997 Garczynski et al.
5,676,231 A 10/1997 Legras et al.
5,676,372 A 10/1997 Sines et al.
5,681,039 A 10/1997 Miller et al.
5,683,085 A 11/1997 Johnson et al.
5,685,543 A 11/1997 Garner et al.
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea et al.
5,711,525 A 1/1998 Breeding et al.
5,718,427 A 2/1998 Cranford et al.
5,719,288 A 2/1998 Sens et al.
5,720,484 A 2/1998 Hsu et al.
5,722,893 A 3/1998 Hill et al.
5,735,525 A 4/1998 McCrea et al.
5,735,724 A 4/1998 Udagawa
5,735,742 A 4/1998 French et al.
5,743,798 A 4/1998 Adams et al.
5,768,382 A 6/1998 Schneier et al.
5,770,533 A 6/1998 Franchi et al.
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 Van Putten et al.
5,788,574 A 8/1998 Ornstein et al.
5,791,988 A 8/1998 Nomi et al.
5,802,560 A 9/1998 Joseph et al.
5,803,808 A 9/1998 Strisower
5,810,355 A 9/1998 Trilli
5,813,326 A 9/1998 Salomon et al.
5,813,912 A 9/1998 Shultz et al.
5,814,796 A 9/1998 Benson et al.
5,836,775 A 11/1998 Hiyama et al.
5,839,730 A 11/1998 Pike
5,845,906 A 12/1998 Wirth et al.
5,851,011 A 12/1998 Lott et al.
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A * 6/1999 McCrea, Jr. ..... A63F 1/12 273/292
5,919,090 A 7/1999 Mothwurf
D412,723 S 8/1999 Hachuel et al.
5,936,222 A 8/1999 Korsunsky et al.
5,941,769 A 8/1999 Order
5,944,310 A 8/1999 Johnson et al.
D414,527 S 9/1999 Tedham
5,957,776 A 9/1999 Hoehne et al.
5,974,150 A 10/1999 Kaish et al.
5,985,305 A 11/1999 Peery et al.
5,989,122 A 11/1999 Roblejo et al.

(56) References Cited

U.S. PATENT DOCUMENTS 5,991,308 A 11/1999 Fuhrmann et al.
6,015,311 A 1/2000 Benjamin et al.
6,019,368 A 2/2000 Sines et al.
6,019,374 A 2/2000 Breeding et al.
6,039,650 A 3/2000 Hill et al.
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea et al.
6,113,101 A 9/2000 Wirth et al.
6,117,012 A 9/2000 McCrea et al.
D432,588 S 10/2000 Tedham
6,126,166 A 10/2000 Lorson et al.
6,127,447 A 10/2000 Mitry et al.
6,131,817 A 10/2000 Miller
6,139,014 A 10/2000 Breeding et al.
6,149,154 A 11/2000 Grauzer et al.
6,154,131 A 11/2000 Jones et al.
6,165,069 A 12/2000 Sines et al.
6,165,072 A 12/2000 Davis et al.
6,183,362 B1 2/2001 Boushy
6,186,895 B1 2/2001 Oliver
6,196,416 B1 3/2001 Seagle
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht
6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 * 9/2001 Hessing ..... A63F 1/12
273/138.1
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block et al.
6,386,973 B1 5/2002 Yoseloff
6,402,142 B1 6/2002 Warren et al.
6,403,908 B2 6/2002 Stardust et al.
6,443,839 B2 9/2002 Stockdale et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,561,897 B1 5/2003 Bourbour et al.
6,568,678 B2 5/2003 Breeding et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hartl
6,585,856 B2 7/2003 Zwick et al.
6,588,750 B1 7/2003 Grauzer et al.
6,588,751 B1 7/2003 Grauzer et al.
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,655,690 B1 12/2003 Oskwarek
6,658,135 B1 12/2003 Morito et al.
6,659,460 B2 12/2003 Blaha et al.
6,659,461 B2 12/2003 Yoseloff et al.
6,659,875 B2 12/2003 Purton
6,663,490 B2 12/2003 Soltys et al.
6,666,768 B1 12/2003 Akers
6,671,358 B1 12/2003 Seidman et al.
6,676,127 B2 1/2004 Johnson et al.
6,676,517 B2 1/2004 Beavers
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 3/2004 Baker et al.
6,698,759 B2 3/2004 Webb et al.
6,702,289 B1 3/2004 Feola
6,702,290 B2 3/2004 Buono-Correa et al.
6,709,333 B1 3/2004 Bradford et al.
6,712,696 B2 3/2004 Soltys et al.
6,719,288 B2 4/2004 Hessing et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,749,510 B2 6/2004 Giobbi
6,758,751 B2 7/2004 Soltys et al.
6,758,757 B2 7/2004 Luciano, Jr. et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow
6,842,263 B1 1/2005 Saeki
6,843,725 B2 1/2005 Nelson

(56) References Cited

U.S. PATENT DOCUMENTS

| | | | |
|---|---|---|---|
| 6,848,616 | B2 | 2/2005 | Tsirline et al. |
| 6,848,844 | B2 | 2/2005 | McCue, Jr. et al. |
| 6,848,994 | B1 | 2/2005 | Knust et al. |
| 6,857,961 | B2 | 2/2005 | Soltys et al. |
| 6,874,784 | B1 | 4/2005 | Promutico |
| 6,874,786 | B2 | 4/2005 | Bruno |
| 6,877,657 | B2 | 4/2005 | Ranard et al. |
| 6,877,748 | B1 | 4/2005 | Patroni |
| 6,886,829 | B2 | 5/2005 | Hessing et al. |
| 6,889,979 | B2 | 5/2005 | Blaha et al. |
| 6,893,347 | B1 | 5/2005 | Zilliacus et al. |
| 6,899,628 | B2 | 5/2005 | Leen et al. |
| 6,902,167 | B2 | 6/2005 | Webb |
| 6,905,121 | B1 | 6/2005 | Timpano |
| 6,923,446 | B2 | 8/2005 | Snow |
| 6,938,900 | B2 | 9/2005 | Snow |
| 6,941,180 | B1 | 9/2005 | Fischer et al. |
| 6,950,948 | B2 | 9/2005 | Neff |
| 6,955,599 | B2 | 10/2005 | Bourbour et al. |
| 6,957,746 | B2 | 10/2005 | Martin et al. |
| 6,959,925 | B1 | 11/2005 | Baker et al. |
| 6,959,935 | B2 | 11/2005 | Buhl et al. |
| 6,960,134 | B2 | 11/2005 | Hartl et al. |
| 6,964,612 | B2 | 11/2005 | Soltys et al. |
| 6,986,514 | B2 | 1/2006 | Snow |
| 6,988,516 | B2 | 1/2006 | Debaes et al. |
| 7,011,309 | B2 | 3/2006 | Soltys et al. |
| 7,020,307 | B2 | 3/2006 | Hinton et al. |
| 7,028,598 | B2 | 4/2006 | Teshima |
| 7,029,009 | B2 | 4/2006 | Grauzer et al. |
| 7,036,818 | B2 | 5/2006 | Grauzer et al. |
| 7,046,458 | B2 | 5/2006 | Nakayama |
| 7,046,764 | B1 | 5/2006 | Kump |
| 7,048,629 | B2 | 5/2006 | Sines et al. |
| 7,059,602 | B2 | 6/2006 | Grauzer et al. |
| 7,066,464 | B2 | 6/2006 | Blad et al. |
| 7,068,822 | B2 | 6/2006 | Scott |
| 7,073,791 | B2 | 7/2006 | Grauzer et al. |
| 7,079,010 | B2 | 7/2006 | Champlin |
| 7,084,769 | B2 | 8/2006 | Bauer et al. |
| 7,089,420 | B1 | 8/2006 | Durst et al. |
| D527,900 | S | 9/2006 | Dewa |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,124,947 | B2 | 10/2006 | Storch |
| 7,128,652 | B1 | 10/2006 | Lavoie et al. |
| 7,137,627 | B2 | 11/2006 | Grauzer et al. |
| 7,139,108 | B2 | 11/2006 | Andersen et al. |
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,213,812 | B2 | 5/2007 | Schubert et al. |
| 7,222,852 | B2 | 5/2007 | Soltys et al. |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Bartman |
| 7,243,148 | B2 | 7/2007 | Keir et al. |
| 7,243,698 | B2 | 7/2007 | Siegel |
| 7,246,799 | B2 | 7/2007 | Snow |
| 7,255,344 | B2 | 8/2007 | Grauzer et al. |
| 7,255,351 | B2 | 8/2007 | Yoseloff et al. |
| 7,255,642 | B2 | 8/2007 | Sines et al. |
| 7,257,630 | B2 | 8/2007 | Cole et al. |
| 7,261,294 | B2 | 8/2007 | Grauzer et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,303,475 | B2 | 12/2007 | Britt et al. |
| 7,309,065 | B2 | 12/2007 | Yoseloff et al. |
| 7,316,609 | B2 | 1/2008 | Dunn et al. |
| 7,316,615 | B2 | 1/2008 | Soltys et al. |
| 7,322,576 | B2 | 1/2008 | Grauzer et al. |
| 7,331,579 | B2 | 2/2008 | Snow |
| 7,334,794 | B2 | 2/2008 | Snow |
| 7,338,044 | B2 | 3/2008 | Grauzer et al. |
| 7,338,362 | B1 | 3/2008 | Gallagher |
| 7,341,510 | B2 | 3/2008 | Bourbour et al. |
| D566,784 | S | 4/2008 | Palmer |
| 7,357,321 | B2 | 4/2008 | Yoshida et al. |
| 7,360,094 | B2 | 4/2008 | Neff |
| 7,367,561 | B2 | 5/2008 | Blaha et al. |
| 7,367,563 | B2 | 5/2008 | Yoseloff et al. |
| 7,367,565 | B2 | 5/2008 | Chiu |
| 7,367,884 | B2 | 5/2008 | Breeding et al. |
| 7,374,170 | B2 | 5/2008 | Grauzer et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,390,256 | B2 | 6/2008 | Soltys et al. |
| 7,399,226 | B2 | 7/2008 | Mishra |
| 7,407,438 | B2 | 8/2008 | Schubert et al. |
| 7,413,191 | B2 | 8/2008 | Grauzer et al. |
| 7,434,805 | B2 | 10/2008 | Grauzer et al. |
| 7,436,957 | B1 | 10/2008 | Fischer et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,478,813 | B1 | 1/2009 | Hofferber et al. |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,537,216 | B2 | 5/2009 | Soltys et al. |
| 7,540,497 | B2 | 6/2009 | Tseng |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida et al. |
| 7,556,266 | B2 | 7/2009 | Blaha et al. |
| 7,575,237 | B2 | 8/2009 | Snow |
| 7,578,506 | B2 | 8/2009 | Lambert |
| 7,584,962 | B2 | 9/2009 | Breeding et al. |
| 7,584,963 | B2 | 9/2009 | Krenn et al. |
| 7,584,966 | B2 | 9/2009 | Snow |
| 7,591,728 | B2 | 9/2009 | Gioia et al. |
| 7,593,544 | B2 | 9/2009 | Downs, III et al. |
| 7,594,660 | B2 | 9/2009 | Baker et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,852 | B2 | 3/2010 | Baker et al. |
| 7,669,853 | B2 | 3/2010 | Jones |
| 7,677,565 | B2 | 3/2010 | Grauzer et al. |
| 7,677,566 | B2 | 3/2010 | Krenn et al. |
| 7,686,681 | B2 | 3/2010 | Soltys et al. |
| 7,699,694 | B2 | 4/2010 | Hill |
| 7,735,657 | B2 | 6/2010 | Johnson |
| 7,740,244 | B2 | 6/2010 | Ho |
| 7,744,452 | B2 | 6/2010 | Cimring et al. |

(56) References Cited

U.S. PATENT DOCUMENTS 7,753,373 B2 7/2010 Grauzer et al.
7,753,374 B2 7/2010 Ho
7,753,798 B2 7/2010 Soltys et al.
7,758,425 B2 7/2010 Poh et al.
7,762,554 B2 7/2010 Ho
7,764,836 B2 7/2010 Downs, III et al.
7,766,332 B2 8/2010 Grauzer et al.
7,766,333 B1 8/2010 Stardust et al.
7,769,232 B2 8/2010 Downs, III
7,769,853 B2 8/2010 Nezamzadeh
7,773,749 B1 8/2010 Durst et al.
7,780,529 B2 8/2010 Rowe et al.
7,784,790 B2 8/2010 Grauzer et al.
7,804,982 B2 9/2010 Howard et al.
7,846,020 B2 12/2010 Walker et al.
7,867,080 B2 1/2011 Nicely et al.
7,890,365 B2 2/2011 Hettinger
7,900,923 B2 3/2011 Toyama et al.
7,901,285 B2 3/2011 Tran et al.
7,908,169 B2 3/2011 Hettinger
7,909,689 B2 3/2011 Lardie
7,931,533 B2 4/2011 LeMay et al.
7,933,448 B2 4/2011 Downs, III
7,946,586 B2 5/2011 Krenn et al.
7,967,294 B2 6/2011 Blaha et al.
7,976,023 B1 7/2011 Hessing et al.
7,988,152 B2 8/2011 Sines
7,988,554 B2 8/2011 LeMay et al.
7,995,196 B1 8/2011 Fraser
8,002,638 B2 8/2011 Grauzer et al.
8,011,661 B2 9/2011 Stasson
8,016,663 B2 9/2011 Soltys et al.
8,021,231 B2 9/2011 Walker et al.
8,025,294 B2 9/2011 Grauzer et al.
8,038,521 B2 10/2011 Grauzer et al.
RE42,944 E 11/2011 Blaha et al.
8,057,302 B2 11/2011 Wells et al.
8,062,134 B2 11/2011 Kelly et al.
8,070,574 B2 12/2011 Grauzer et al.
8,092,307 B2 1/2012 Kelly
8,092,309 B2 1/2012 Bickley
8,109,514 B2 2/2012 Toyama
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 1/2013 Scheper et al.
8,342,526 B1 1/2013 Sampson et al.
8,342,529 B2 1/2013 Snow
8,353,513 B2 1/2013 Swanson
8,381,918 B2 2/2013 Johnson
8,419,521 B2 4/2013 Grauzer et al.
8,429,229 B2 4/2013 Sepich et al.
8,444,147 B2 5/2013 Grauzer et al.
8,444,489 B2 5/2013 Lian et al.
8,469,360 B2 6/2013 Sines
8,475,252 B2 7/2013 Savage et al.
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,556,263 B2 10/2013 Grauzer et al.
8,579,289 B2 11/2013 Rynda et al.
8,602,416 B2 12/2013 Toyama
8,616,552 B2 12/2013 Czyzewski et al.
8,628,086 B2 1/2014 Krenn et al.
8,651,485 B2 2/2014 Stasson
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,820,745 B2 9/2014 Grauzer et al.
8,844,930 B2 9/2014 Sampson et al.
8,899,587 B2 12/2014 Grauzer et al.
8,919,775 B2 12/2014 Wadds et al.
9,251,661 B2 2/2016 Tammesoo
9,280,866 B2 3/2016 Nayak et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,679,603 B2 6/2017 Kelly et al.
9,731,190 B2 8/2017 Sampson et al.
2001/0036231 A1 11/2001 Easwar et al.
2001/0036866 A1 11/2001 Stockdale et al.
2002/0017481 A1 2/2002 Johnson et al.
2002/0030425 A1 3/2002 Tiramani et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer et al.
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 4/2003 Blaha et al.
2003/0087694 A1 5/2003 Starch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0023752 A1 2/2005 Grauzer et al.
2005/0026680 A1 2/2005 Gururajan
2005/0035548 A1 2/2005 Yoseloff et al.
2005/0037843 A1 2/2005 Wells et al.
2005/0040594 A1 2/2005 Krenn et al.

(56) References Cited

U.S. PATENT DOCUMENTS

| | | | |
|---|---|---|---|
| 2005/0051955 | A1 | 3/2005 | Schubert et al. |
| 2005/0051956 | A1 | 3/2005 | Grauzer et al. |
| 2005/0062227 | A1 | 3/2005 | Grauzer et al. |
| 2005/0062228 | A1 | 3/2005 | Grauzer et al. |
| 2005/0062229 | A1 | 3/2005 | Grauzer et al. |
| 2005/0082750 | A1 | 4/2005 | Grauzer et al. |
| 2005/0093231 | A1 | 5/2005 | Grauzer et al. |
| 2005/0104289 | A1 | 5/2005 | Grauzer et al. |
| 2005/0104290 | A1 | 5/2005 | Grauzer et al. |
| 2005/0110210 | A1 | 5/2005 | Soltys et al. |
| 2005/0113166 | A1 | 5/2005 | Grauzer et al. |
| 2005/0113171 | A1 | 5/2005 | Hodgson |
| 2005/0119048 | A1 | 6/2005 | Soltys et al. |
| 2005/0121852 | A1 | 6/2005 | Soltys et al. |
| 2005/0137005 | A1 | 6/2005 | Soltys et al. |
| 2005/0140090 | A1 | 6/2005 | Breeding et al. |
| 2005/0146093 | A1 | 7/2005 | Grauzer et al. |
| 2005/0148391 | A1 | 7/2005 | Tain |
| 2005/0164759 | A1 | 7/2005 | Smith et al. |
| 2005/0164761 | A1 | 7/2005 | Tain |
| 2005/0192092 | A1 | 9/2005 | Breckner et al. |
| 2005/0206077 | A1 | 9/2005 | Grauzer et al. |
| 2005/0242500 | A1 | 11/2005 | Downs |
| 2005/0272501 | A1 | 12/2005 | Tran et al. |
| 2005/0277463 | A1 | 12/2005 | Knust et al. |
| 2005/0288083 | A1 | 12/2005 | Downs |
| 2005/0288086 | A1 | 12/2005 | Schubert et al. |
| 2006/0027970 | A1 | 2/2006 | Kyrychenko |
| 2006/0033269 | A1 | 2/2006 | Grauzer et al. |
| 2006/0033270 | A1 | 2/2006 | Grauzer et al. |
| 2006/0046853 | A1 | 3/2006 | Black |
| 2006/0063577 | A1 | 3/2006 | Downs et al. |
| 2006/0066048 | A1 | 3/2006 | Krenn et al. |
| 2006/0084502 | A1 | 4/2006 | Downs et al. |
| 2006/0151946 | A1 | 7/2006 | Ngai |
| 2006/0181022 | A1 | 8/2006 | Grauzer et al. |
| 2006/0183540 | A1 | 8/2006 | Grauzer et al. |
| 2006/0189381 | A1 | 8/2006 | Daniel et al. |
| 2006/0199649 | A1 | 9/2006 | Soltys et al. |
| 2006/0205508 | A1 | 9/2006 | Green |
| 2006/0220312 | A1 | 10/2006 | Baker et al. |
| 2006/0220313 | A1 | 10/2006 | Baker et al. |
| 2006/0252521 | A1 | 11/2006 | Gururajan et al. |
| 2006/0252554 | A1 | 11/2006 | Gururajan et al. |
| 2006/0279040 | A1 | 12/2006 | Downs et al. |
| 2006/0281534 | A1 | 12/2006 | Grauzer et al. |
| 2007/0001395 | A1 | 1/2007 | Gioia et al. |
| 2007/0006708 | A1 | 1/2007 | Laakso |
| 2007/0015583 | A1 | 1/2007 | Tran |
| 2007/0018389 | A1 | 1/2007 | Downs |
| 2007/0045959 | A1 | 3/2007 | Soltys |
| 2007/0049368 | A1 | 3/2007 | Kuhn et al. |
| 2007/0057454 | A1 | 3/2007 | Fleckenstein |
| 2007/0057469 | A1 | 3/2007 | Grauzer et al. |
| 2007/0066387 | A1 | 3/2007 | Matsuno et al. |
| 2007/0069462 | A1 | 3/2007 | Downs et al. |
| 2007/0072677 | A1 | 3/2007 | Lavoie et al. |
| 2007/0102879 | A1 | 5/2007 | Stasson |
| 2007/0111773 | A1 | 5/2007 | Gururajan et al. |
| 2007/0148283 | A1 | 6/2007 | Harvey et al. |
| 2007/0184905 | A1 | 8/2007 | Gatto et al. |
| 2007/0197294 | A1 | 8/2007 | Gong |
| 2007/0197298 | A1 | 8/2007 | Rowe |
| 2007/0202941 | A1 | 8/2007 | Miltenberger et al. |
| 2007/0222147 | A1 | 9/2007 | Blaha et al. |
| 2007/0225055 | A1 | 9/2007 | Weisman |
| 2007/0233567 | A1 | 10/2007 | Daly |
| 2007/0238506 | A1 | 10/2007 | Ruckle |
| 2007/0241498 | A1 | 10/2007 | Soltys |
| 2007/0259709 | A1 | 11/2007 | Kelly et al. |
| 2007/0267812 | A1 | 11/2007 | Grauzer et al. |
| 2007/0272600 | A1 | 11/2007 | Johnson |
| 2007/0278739 | A1 | 12/2007 | Swanson |
| 2007/0287534 | A1 | 12/2007 | Fleckenstein |
| 2007/0290438 | A1 | 12/2007 | Grauzer et al. |
| 2007/0298865 | A1 | 12/2007 | Soltys |
| 2008/0004107 | A1 | 1/2008 | Nguyen et al. |
| 2008/0006997 | A1 | 1/2008 | Scheper et al. |
| 2008/0006998 | A1 | 1/2008 | Grauzer et al. |
| 2008/0022415 | A1 | 1/2008 | Kuo et al. |
| 2008/0032763 | A1 | 2/2008 | Giobbi |
| 2008/0039192 | A1 | 2/2008 | Laut |
| 2008/0039208 | A1 | 2/2008 | Abrink et al. |
| 2008/0096656 | A1 | 4/2008 | LeMay et al. |
| 2008/0111300 | A1 | 5/2008 | Czyzewski et al. |
| 2008/0113700 | A1 | 5/2008 | Czyzewski et al. |
| 2008/0113783 | A1 | 5/2008 | Czyzewski et al. |
| 2008/0136108 | A1 | 6/2008 | Polay |
| 2008/0143048 | A1 | 6/2008 | Shigeta |
| 2008/0176627 | A1 | 7/2008 | Lardie |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0303210 | A1 | 12/2008 | Grauzer et al. |
| 2008/0315517 | A1 | 12/2008 | Toyama |
| 2009/0026700 | A2 | 1/2009 | Shigeta |
| 2009/0048026 | A1 | 2/2009 | French |
| 2009/0054161 | A1 | 2/2009 | Schubert et al. |
| 2009/0072477 | A1 | 3/2009 | Tseng |
| 2009/0091078 | A1 | 4/2009 | Grauzer et al. |
| 2009/0100409 | A1 | 4/2009 | Toneguzzo |
| 2009/0104963 | A1 | 4/2009 | Burman et al. |
| 2009/0121429 | A1 | 5/2009 | Walsh |
| 2009/0134575 | A1 | 5/2009 | Dickinson et al. |
| 2009/0140492 | A1 | 6/2009 | Yoseloff et al. |
| 2009/0166970 | A1 | 7/2009 | Rosh |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0189346 | A1 | 7/2009 | Krenn et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267296 | A1 | 10/2009 | Ho |
| 2009/0267297 | A1 | 10/2009 | Blaha et al. |
| 2009/0283969 | A1 | 11/2009 | Tseng |
| 2009/0298577 | A1 | 12/2009 | Gagner et al. |
| 2009/0302535 | A1 | 12/2009 | Ho |
| 2009/0302537 | A1 | 12/2009 | Ho |
| 2009/0312093 | A1 | 12/2009 | Walker et al. |
| 2009/0314188 | A1 | 12/2009 | Toyama et al. |
| 2010/0013152 | A1 | 1/2010 | Grauzer et al. |
| 2010/0038849 | A1 | 2/2010 | Scheper et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0244382 | A1 | 9/2010 | Snow |
| 2010/0252992 | A1 | 10/2010 | Sines |
| 2010/0255899 | A1 | 10/2010 | Paulsen |
| 2010/0276880 | A1 | 11/2010 | Grauzer et al. |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer et al. |
| 2011/0006480 | A1 | 1/2011 | Grauzer et al. |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta et al. |
| 2011/0078096 | A1 | 3/2011 | Bounds |
| 2011/0079959 | A1 | 4/2011 | Hartley |
| 2011/0105208 | A1 | 5/2011 | Bickley |

(56) References Cited

U.S. PATENT DOCUMENTS

| | | | |
|---|---|---|---|
| 2011/0109042 | A1 | 5/2011 | Rynda et al. |
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230268 | A1 | 9/2011 | Williams |
| 2011/0269529 | A1 | 11/2011 | Baerlocher |
| 2011/0272881 | A1 | 11/2011 | Sines |
| 2011/0285081 | A1 | 11/2011 | Stasson |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1 | 4/2012 | Blaha et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer et al. |
| 2012/0181747 | A1 | 7/2012 | Grauzer et al. |
| 2012/0187625 | A1 | 7/2012 | Downs, III et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0085638 | A1 | 4/2013 | Weinmann et al. |
| 2013/0099448 | A1 | 4/2013 | Scheper et al. |
| 2013/0109455 | A1 | 5/2013 | Grauzer et al. |
| 2013/0132306 | A1 | 5/2013 | Kami et al. |
| 2013/0147116 | A1 | 6/2013 | Stasson |
| 2013/0161905 | A1 | 6/2013 | Grauzer et al. |
| 2013/0228972 | A1 | 9/2013 | Grauzer et al. |
| 2013/0241147 | A1 | 9/2013 | McGrath |
| 2013/0300059 | A1 | 11/2013 | Sampson et al. |
| 2013/0337922 | A1 | 12/2013 | Kuhn et al. |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2015/0021242 | A1 | 1/2015 | Johnson |
| 2015/0069699 | A1 | 3/2015 | Blazevic |
| 2015/0238848 | A1 | 8/2015 | Kuhn et al. |
| 2017/0157499 | A1 | 6/2017 | Krenn et al. |
| 2018/0085658 | A1 | 3/2018 | Helsen et al. |
| 2018/0089956 | A1 | 3/2018 | Nagaragatta et al. |

FOREIGN PATENT DOCUMENTS

| | | | |
|---|---|---|---|
| AU | 697805 | B2 | 10/1998 |
| AU | 757636 | B2 | 2/2003 |
| CA | 2266555 | A1 | 4/1998 |
| CA | 2284017 | A1 | 9/1998 |
| CA | 2612138 | A1 | 12/2006 |
| CN | 2051521 | U | 1/1990 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 201085907 | Y | 7/2008 |
| CN | 201139926 | Y | 10/2008 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 2002724641 | U | 2/2013 |
| CN | 202983149 | U | 6/2013 |
| CZ | 24952 | U1 | 2/2013 |
| DE | 2757341 | A1 | 6/1978 |
| DE | 2816377 | A1 | 10/1979 |
| DE | 3807127 | A1 | 9/1989 |
| EP | 777514 | B1 | 2/2000 |
| EP | 1194888 | A1 | 4/2002 |
| EP | 1502631 | A1 | 2/2005 |
| EP | 1713026 | A1 | 10/2006 |
| EP | 2228106 | A1 | 9/2010 |
| EP | 1575261 | B1 | 8/2012 |
| FR | 2375918 | A1 | 7/1978 |
| GB | 289552 | A | 4/1928 |
| GB | 337147 | A | 10/1930 |
| GB | 414014 | A | 7/1934 |
| GB | 672616 | A | 5/1952 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003250950 | A | 9/2003 |
| JP | 2005198668 | A | 7/2005 |
| JP | 2008246061 | A | 10/2008 |
| JP | 4586474 | B2 | 11/2010 |
| TW | M335308 | U | 7/2008 |
| TW | M359356 | U | 6/2009 |
| TW | I345476 | B | 7/2011 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |
| WO | 9952610 | A1 | 10/1999 |
| WO | 9952611 | A1 | 10/1999 |
| WO | 200051076 | | 8/2000 |
| WO | 0156670 | A1 | 8/2001 |
| WO | 0205914 | A1 | 1/2002 |
| WO | 03004116 | A1 | 1/2003 |
| WO | 2004067889 | A1 | 8/2004 |
| WO | 2004112923 | A1 | 12/2004 |
| WO | 2006031472 | A2 | 3/2006 |
| WO | 2006039308 | A2 | 4/2006 |
| WO | 2008005286 | A2 | 1/2008 |
| WO | 2008006023 | A2 | 1/2008 |
| WO | 2008091809 | A2 | 7/2008 |
| WO | 2009067758 | A1 | 6/2009 |
| WO | 2009137541 | A2 | 11/2009 |
| WO | 2010052573 | A2 | 5/2010 |
| WO | 2010055328 | | 5/2010 |
| WO | 2010117446 | | 10/2010 |
| WO | 2013019677 | | 2/2013 |
| WO | 2016058085 | A9 | 4/2016 |

OTHER PUBLICATIONS

"Automatic casino card shuffle," Alibaba.com, (last visited Jul. 22, 2014), 2 pages.

"Error Back propagation," http://willamette.edu~gorr/classes/cs449/backprop.html (4 pages), Nov. 13, 2008.

"i-Deal," Bally Technologies, Inc., (2014), 2 pages.

"Shufflers—SHFL entertainment," Gaming Concepts Group, (2012), 6 pages.

"TAG Archives: Shuffle Machine," Gee Wiz Online, (Mar. 25, 2013), 4 pages.

1/3" B/W CCD Camera Module EB100 by EverFocus Electronics Corp., Jul. 31, 2001, 3 pgs.

(56) References Cited

OTHER PUBLICATIONS

Australian Examination Report for Australian Application No. 2008202752, dated Sep. 25, 2009, 2 pages.
Australian Examination Report for Australian Application No. 2010202856, dated Aug. 11, 2011, 2 pages.
Australian Provisional Patent Application for Australian Patent Application No. PM7441, filed Aug. 15, 1994, Applicants: Rodney G. Johnson et al., Title: Card Handling Apparatus, 13 pages.
Canadian Office Action for Canadian Application No. 2,461,726, dated Jul. 19, 2010, 3 pages.
Canadian Office Action for CA 2,580,309 dated Mar. 20, 2012 (6 pages).
Canadian Office Action for Canadian Application No. 2,461,726, dated Dec. 11, 2013, 3 pages.
Christos Stergiou and Dimitrios Siganos, "Neural Networks," http://www.doc.ic.ac.uk/~nd/surprise_96/journal/vol4/cs11/report.html (13 pages), Dec. 15, 2011.
Complaint filed in the matter of *SHFL entertainment, In.* v. *DigiDeal Corporation*, U.S. District Court, District of Nevada, Civil Action No. CV 2:12-cv-01782-GMC-VCF, Oct. 10, 2012, 62 pages.
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 19 of 23 (color copies from Binder 3).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 20 of 23 (color copies from Binder 4).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 21 of 23 (color copies from Binder 6).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 22 of 23 (color copies from Binder 8, part 1 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
DVD labeled Luciano Decl. Ex. K is (see Binder 2-1, p. 215/237, Luciano Decl., para.14): A video demonstration (11minutes) of a Luciano Packaging prototype shuffler. DVD sent to Examiner by US Postal Service with this PTO/SB/08 form.
DVD labeled Morrill Decl. Ex. A is (see Binder 4-1, p. 149/206, Morrill Decl., para. 2.): A video (16 minutes) that the attorney for CARD, Robert Morrill, made to describe the Roblejo prototype card shuffler. DVD sent to Examiner by US Postal Service with this PTO/SB/08 form.
DVD labeled Solberg Decl.Ex.C, which is not a video at all, is (see Binder 4-1, p. 34/206, Solberg Decl., para.8): Computer source code for operating a computer-controlled card shuffler (an early Roblejo prototype card shuffler) and descriptive comments of how the code works. DVD sent to Examiner by US Postal Service with this PTO/SB/08 form.
DVD labeled Exhibit 1. This is a DVD taken by Shuffle Master personnel of the live operation of a CARD One2Six™ Shuffler (Oct. 7, 2003). DVD sent to Examiner by US Postal Service with this PTO/SB/08 form.
European Examination Report for European Application No. 02 780 410, dated Jan. 25, 2010, 5 pages.
European Examination Report for European Application No. 02 780 410, dated Aug. 9, 2011, 4 pages.
European Patent Application Search Report—European Patent Application No. 06772987.1, dated Dec. 10, 2009, 5 pages.
European Search Report for European Application No. 12 152 303, dated Apr. 16, 2012, 3 pages.

(56) References Cited

OTHER PUBLICATIONS

Genevieve Orr, CS-449: Neural Networks Willamette University, http://www.willamette.edu/~gorr/classes/cs449/intro.html (4 pages), Fall 1999.
https://web.archive.org/web/19991004000323/http://travelwizardtravel.com/majon.htm, Oct. 4, 1999, 2 pages.
http://www.google.com/search?tbm=pts&q=Card+handling+devicve+with+input+and+outpu . . . Jun. 8, 2012.
http://www.google.com/search?tbm=pts&q=shuffling+zone+onOopposite+site+of+input+. . . Jul. 18, 2012.
http://www.ildado.com/casino_glossary.html, Feb. 1, 2001, p. 1-8.
Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, May 9, 2009, 4 pages.
PCT International Preliminary Examination Report for International Patent Application No. PCT/US02/31105 dated Jul. 28, 2004, 9 pages.
PCT International Search Report and Written Opinion for International Patent Application No. PCT/US2006/22911, dated Jun. 1, 2007, 6 pages.
PCT International Search Report and Written Opinion for International Application No. PCT/US2007/023168, dated Sep. 12, 2008, 8 pages.
PCT International Search Report and Written Opinion for International Application No. PCT/US2007/022858, dated Mar. 7, 2008, 7 pages.
PCT International Search Report and Written Opinion for PCT/US07/15036, dated Sep. 23, 2008, 6 pages.
PCT International Search Report and Written Opinion for PCT/US07/15035, dated Sep. 29, 2008, 6 pages.
PCT International Search Report and Written Opinion of the International Searching Authority for PCT/GB2011/051978, dated Jan. 17, 2012, 11 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion of the International Searching Authority for PCT/US13/59665, dated Apr. 25, 2014, 21 pages.
PCT International Search Report and Written Opinion of the International Searching Authority for PCT/US2008/007069, dated Sep. 8, 2008, 10 pages.
PCT International Search Report and Written Opinion of the International Searching Authority for PCT/US2010/001032, dated Jun. 16, 2010, 11 pages.
PCT International Search Report and Written Opinion, PCT Application No. PCT/US2013/062391, dated Dec. 17, 2013, 13 pages.
PCT International Search Report and Written Opinion, PCT/US12/48706, dated Oct. 16, 2012, 12 pages.
PCT International Search Report for International Application No. PCT/US2003/015393, dated Oct. 6, 2003, 2 pages.
PCT International Search Report for PCT/US2005/034737 dated Apr. 7, 2006, 1 page (WO06/039308).
PCT International Search Report for PCT/US2007/022894, dated Jun. 11, 2008, 3 pages.
PCT International Search Report and Written Opinion of the International Searching Authority for PCT/US05/31400, dated Sep. 25, 2007, 12 pages.
PCT International Search Report and Written Opinion, PCT Application No. PCT/US2015/022158, dated Jun. 17, 2015, 13 pages.
PCT International Search Report and Written Opinion, PCT Application No. PCT/US2015/040196, dated Jan. 15, 2016, 20 pages.
Philippines Patent Application Formality Examination Report—Philippines Patent Application No. 1-2006-000302, dated Jun. 13, 2006.
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Scarne's Encyclopedia of Games by John Scarne, 1973, "Super Contract Bridge", p. 153.
Service Manual/User Manual for Single Deck Shufflers: BG1, BG2 and BG3 by Shuffle Master © 1997, 151 page.
SHFL Entertainment, Inc., Opening Claim Construction Brief, filed in Nevada District Court Case No. 2:12-cv-01782 with exhibits, Aug. 8, 2013, p. 1-125.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Master, Inc.
Shuffle Master's Reply Memorandum in Support of Shuffle Master's Motion for Preliminary Injunction for *Shuffle Master, Inc.* vs. *VendingData Corporation*, In the U.S. District Court, District of Nevada, No. CV-S-04-1373-JCM-LRL, Nov. 29, 2004.
Singapore Patent Application Examination Report—Singapore Patent Application No. SE 2008 01914 A, Jun. 18, 2008, 9 pages.
Statement of Relevance of Cited References, Submitted as Part of a Third-Party Submission Under 37 CFR 1.290 on Dec. 7, 2012 (12 pages).
Tbm=pts&hl=en Google Search for card handling device with storage area, card removing system pivoting arm and processor . . . ; http://www.google.com/?tbrn=pts&hl=en; Jul. 28, 2012, 2 pages.
Tracking the Tables, by Jack Bularsky, Casino Journal, May 2004, vol. 17, No. 5, pp. 44-47.
United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc.* vs. *VendingData Corporation*, In the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc.* vs. *VendingData Corporation*, In the U.S. District Court, District of Nevada, No. CV-S-04-1373-JCM-LRL, Mar. 14, 2005.
Advansys, "Player Tracking" http://advansys.si/products/tablescanner/player-tracking/[Sep. 23, 2016 1:41:34 PM], 4 pages.
Bally Systems Catalogue, Ballytech.com/systems, 2012, 13 pages.
European Opinion for European Application No. 2770550.8, dated Sep. 18, 2017, 9 pages.
Shuffle Master, Inc. (1996). Let It Ride, The Tournament, User Guide, 72 pages.
Weisenfeld, Bernie; Inventor betting on shuffler; Courier-Post; Sep. 11, 1990; 1 page.
Solberg, Halvard; Deposition; *Shuffle Tech International* v. *Scientific Games Corp.*, et al. 1:15-cv-3702 (N.D. III.); Oct. 18, 2016; pp. 187, 224-246, 326-330, 338-339, 396; Baytowne Reporting; Panama City, FL.
Prototype Glossary and Timelines; *Shuffle Tech International* v. *Scientific Games Corp.*, et al. 1:15-cv-3702 (N. D. III.); undated; pp. 1-4.
Olsen, Eddie; Automatic Shuffler 'ready' for Atlantic City experiment; Blackjack Confidential; Jul./Aug. 1989; pp. 6-7.
Gros, Roger; New Card Management System to Be Tested At Bally's Park Place; Casino Journal; Apr. 1989; 5 pages.
Gola, Steve; Deposition; *Shuffle Tech International* v. *Scientific Games Corp., et al.* 1:15-cv-3702 (N.D. III.); Oct. 13, 2016; pp. 1, 9-21, 30-69, 150-167, 186-188, 228-231, 290-315, 411; Henderson Legal Services, Inc.; Washington, DC.

* cited by examiner

METHOD AND APPARATUS FOR USING UPSTREAM COMMUNICATION IN A CARD SHUFFLER

CROSS-REFERENCE TO RELATED APPLICATIONS

This application is a divisional of U.S. patent application Ser. No. 13/719,059, filed Dec. 18, 2012, now U.S. Pat. No. 9,452,346, issued Sep. 27, 2016 which is a continuation of U.S. patent application Ser. No. 09/967,500, filed Sep. 28, 2001, now U.S. Pat. No. 8,337,296, issued Dec. 25, 2012, the disclosure of each of which is incorporated herein in its entirety by this reference.

This application is related to U.S. patent application Ser. No. 15/067,850, filed Mar. 11, 2016, which is a continuation of U.S. patent application Ser. No. 13/719,059.

FIELD OF THE INVENTION

The present invention relates to the field of casino gaming, casino table gaming, casino table card gaming, and the tracking and monitoring of the widest possible parameters of that gaming environment.

BACKGROUND OF THE ART

The casino is probably the most controlled and secure environment frequented by people. To protect against cheating, there have been overhead walkways, floor walkers, pit bosses and other individuals acting as observers in casinos for many years. As technology has advanced, there are surveillance cameras in the casinos, at every conceivable location. These monitors have live viewers and videotaping to record evidence, and cover essentially every exposed area in a casino. The resolution on the cameras is sufficient to read the lettering on U.S. currency, even from cameras located twenty or thirty feet away.

The security objective in the casino is primarily aimed at protecting the casino against lost winnings because of cheating at the tables or slot machines. Although customers in the casino are also under surveillance to guard them against robbery or harm, the primary objective is definitely to protect the profit margin of the casino. As the profitably of play in the casino determines the bottom line of the casinos, controlling unnecessary losses is a reasonable objective.

In the play of casino table games where cards are used in play and chips or tokens are used to place wagers, two of the most significant venues for dishonesty are in switching cards, and in altering the value of chips placed as wagers. The skill of certain individuals in performing these tasks is at best difficult if not impossible to observe, the skill sometimes reaching the level of magicians in switching, palming, and adding chips and/or cards during play. Even under repeated scrutiny with video observation, the visual evidence is less than satisfactory against the most skilled cheats.

Additionally, when a dealer is operating in conspiracy with a player, the nature of the security violation can rapidly change at a table and will not be as readily observable as where the same type of illegal act is repeated. It is difficult to get physical evidence where such a conspiracy exits, as where dealer's cards are purposely exposed to provide a player with additional information, or the dealer is manipulating cards, as by withholding a group of cards from shuffling or positioning a preset group of cards so that a player will have a certain win.

Casinos are also less than thrilled with card counters at the blackjack table. Even though there are few individuals who can successfully and regularly practice this technique, and even though the skill is legal, there is evidence that a skilled card counter can win over one hundred thousand dollars per year. Card counters are identified only by specific betting traits, and these have been observed by visual inspection of the tables. To encourage higher gross levels of wagering by players, casinos often extend complimentary goods and services to players in exchange for more active wagering. This is conventionally known as "comping" and the casino operators award players "comps." Comps can be any redeemable forms of currency and/or currency equivalent typically issued (for promotional purposes) by casinos to their players in exchange for active, table game patronage. Such comps include points, club points, premium points, player club points, coupons (e.g., free meals, free rooms, free shows, free gifts, etc.), comp dollars and/or any other form of redeemable coupons, vouchers, cash rebates, goods or services.

Certain casinos offer players club cards. Players can insert the club card into a conventional slot machine and as the player plays the slot machine, tickets (or other comp credits) may be issued based upon the gross wagers made during the time the player plays the slot machine (e.g., one ticket whenever the accumulative wager equals $100). This is an example of one stand-alone comp-awarding approach wherein the comp determination and the delivery of tickets are made at the slot machine.

A player entitled to comps or attempting to earn comps identifies himself/herself upon initiation of a gambling session (i.e., the period during which the player participates actively in a form of gambling). The casino then determines the player's "gross session wager" (i.e., the total currency value put at stake by the player over the course of the gambling session). The casino multiplies the gross session wager by the house advantage (i.e., the percentage of total amount wagered that the casino can expect to win in accordance with the inherent statistical probability of a given game type), thus producing a theoretical expected win (i.e., the product of gross session wager multiplied by house advantage and usually expressed in units of currency).

The casino then expresses the theoretical expected win as a currency value and multiplies the theoretical expected win by an internal percentage known as the comp factor (i.e., the percentage of the theoretical expected win, which the casino is willing to return to players in the form of complimentary goods and/or services—a typical range is fifteen to forty-five percent of the theoretical expected win), thus producing available comp (i.e., the product of the theoretical expected win multiplied by the comp factor, which may be expressed as units of currency or point equivalents). The player then requests goods and/or services in exchange for his or her play at the gaming sessions. The casino determines the value of the goods and/or services requested and the player's available comp and provided that the available comp is sufficient, the good and/or service is delivered. The available comp is adjusted to reflect the value of the good and/or service delivered.

In conventional automated game machines such as slot machines, an accurate determination of available comp conventionally occurs. The player inserts the club card into a card-reading device at the gaming machine. The processor in the gaming machine communicates with a remote game machine management system (computer) and updates the specific player file in a system database. The player conducts the gaming session at the gaming machine and, during the gaming session, the processor updates the player file with the currency value of each game. The currency values accrue within individual player files, resulting in either periodic or real-time, positive adjustments to the gross wager balance for the player. When a player requests goods and/or services, the values of gross wager and house advantage (fixed percentage in slot machines) are inserted into the theoretical expected win equation. The comp factor (configurable by the casino) is then applied to the theoretical expected win, thus resulting in an available comp for the player. The system determines the value of the goods and/or services requested, as well as player's available comp. Provided that the available comp is sufficient, the goods and/or services are delivered to the player and the available comp balance is decremented to reflect the value of the goods and/or services delivered. Typical slot management and casino management systems that operate in the manner described above are conventionally provided in the gaming industry.

When attempting to determine available comp for live card table game players, however, casinos are dependent upon human assessments of both gross wager and house advantage. As a result, casinos approximate these variables. The player notifies casino personnel of his/her presence at the game table and presents a club card. A casino employee takes the club card and inputs it at a remote terminal, thereby updating the specific player file in the table system database. The player conducts the gaming session. A casino employee, usually a pit person, surveys the player's wagering activity periodically, making handwritten assessments of average wagers on paper slips or cards. The player concludes the gaming session and leaves. Once a casino employee notices that a player has departed, the handwritten assessments of the average wagers are summed and divided by the number of manual assessments (e.g., $75+$50+$25/3 games=$50 per game). The casino employee updates the player file with the average wager information by inputting it into the system and closes the pending gaming session for the player. The resident system establishes a gross wager by multiplying the observed average wager by session duration and a decisions per hour constant. In order to establish a surrogate measure of a player's gross wager, casinos multiply an estimated average wager by both the number of hours played and a decisions per hour constant. This constant represents the casino's best guess as to the average number of decisions made by the average player over the course of an hour. Expressed mathematically, therefore, this process appears as follows: Gross Wager ($)=Average Wager ($) X Time X Decisions Constant. These wagering values accrue within individual player files, resulting in either periodic or real-time, positive adjustments to the gross wager balance. When determining a theoretical expected win, most represent house advantage with either a "worst case" or a "middle-of-the-road" percentage. In blackjack, for example, the house advantage against a player of exceptional skill (worst case) is approximately 0.5%, whereas the house advantage over a player of poor skill may be as high as 3.0%. Although some table systems do provide for the manipulation of house advantage on an individual basis, this manipulation seldom occurs and house advantage becomes a constant in practice. The predefined comp factor is then applied to the theoretical expected win, thus resulting in available comp for the player. The resident system then determines the value of the good and/or service requested, as well as the player's available comp. Provided that the available comp is sufficient, the good and/or service is delivered and the available comp balance is adjusted to reflect the value of the good and/or service delivered.

A need exists to fully automate the player rating process at a live card gaming table in a casino to accurately rate the player and to reduce labor costs. Without question, player ratings based only on human observations are inaccurate. Supervisors can easily over-assess or under-assess a particular player's rating. Furthermore, the labor costs for the supervisors are expensive.

Systems are conventionally available to assist operators in player rating determinations. However, these systems are still dependent upon subjective assessments of time played, average wager, and house advantage. A need exists to eliminate the "subjectiveness" in these assessments.

Some systems provide automated equipment for tracking a player's betting activity. Examples of manufacturers who offer such automated equipment include a Precision Resource Corporation product, PITRAK™ (U.S. Pat. No. 5,613,912), and a Grips Systems, Inc. product, GOLDEN EYE™ (WO 97/010577). These systems provide rail-based card-reading units in order to allocate accurately the length of time the player is at the gaming table. However, these systems are still dependent upon the subjective assessment of average wager and house advantage. A need exists to completely automate this feature.

A need has been recognized to reward the players comps for their gaming activity at a game table based upon an accurate determination of a player's wagering activity. A need exists to deliver room, food, and other such comps to players of table games based upon such accurate determinations.

U.S. Pat. No. 6,267,671 describes a comp rating system for a player at a game table upon which a live card game is played, the game table having a player position, the game table having a wager area at the player position, the comp rating system comprising: a player data medium, the player data medium having player identifying data, a reader at the player position, the reader obtaining the player identifying data from the player data medium when the player data medium accesses the reader, a wager having at least one wagering device placed at the wager area, each of the at least one wagering device having value identifying data, a decoder at the game table receiving the value identifying data from the at least one wagering device placed at the wager area, the decoder determining a value of the wager for each live card game played at the game table, a first computer at the game table, the first computer connected to the reader and the decoder, the first computer generating a table record containing the player identifying data, and the wager value for each live card game, the first computer determining a gross session wager value when the player data medium is removed from the reader, a player database record containing a player history record updated by the first computer, a second computer connected to the player database record, the second computer receiving the table record and the player history record from the player database record upon receiving a comp request, the second computer determining whether the comp request is available, a network including at least the second computer, a host management system, a junket agent compensation request having at least one player identification, the host management system accessing the player history record from the player database record when the player history record matches the at least one player identification in the junket agent compensation request, thereby selecting only the player history record required to compensate a junket agent.

U.S. Pat. No. 6,270,404 discloses a video table game system comprising systems and methods for playing live casino-type card games, in particular blackjack. The systems include a presentation unit having video displays that portray virtual playing cards and other information at gaming tables attended by live participants. Shuffling, cutting, dealing and return of playing cards are accomplished using data processing functions within an electronic game processor or processors that enable these functions to be performed quickly and without manual manipulation of playing cards. The invention allows casinos to speed play and reduce the risk of cheating while maintaining the attractive ambiance of a live table game. This system has a single table computer and possibly a central reporting computer, but also suffers from the fact that many players still prefer the use of physical cards during play of casino table games.

U.S. Pat. No. 6,257,981 describes a system for monitoring and configuring gaming devices interconnected over a high-speed network. The system can support a file server, one or more floor controllers, one or more pit terminals, and other terminals all interconnected over the network. Each gaming device includes an electronic module that allows the gaming device to communicate with a floor controller over a current loop network. The electronic module includes a player-tracking module and a data communication node. The player-tracking module includes a card reader for detecting a player-tracking card inserted therein that identifies the player. The data communication node communicates with both the floor controller and the gaming device. The data communication node communicates with the gaming device over a serial interface through which the data communication node transmits reconfiguration commands. The gaming device reconfigures its payout schedule responsive to the reconfiguration commands to provide a variety of promotional bonuses such as multiple jackpot bonuses, mystery jackpot bonuses, progressive jackpot bonuses, or player specific bonuses.

U.S. Pat. No. 6,234,900 describes a system and method for tracking the play of players playing gaming devices such as slot machines through passive identification of the players. Passive identification can be achieved by analysis of a player, such as facial image photography, infrared scan, scans of a player's iris or other features of the eye, and the like. Players provide identification information and physical recognition data is acquired as by a digital or video camera. For each player, an account file and a file of the image data is stored. When the player plays the slot machine, a camera scans the player and acquires image data that is compared to stored data to identify the player. The identified player's account file is opened and data from the device representing parameters of play, e.g., amounts wagered, is allocated to the identified player's account file for the purpose of providing comps and other benefits to the player. "Doe" image data and account files can be stored to allocate parameters for unidentified players. Further, the device acquired image data can be compared with stored image data to identify undesirables such as slot cheats or the like.

U.S. Pat. No. 6,186,895 describes an intelligent casino chip system. At least one gaming table is provided with at least one discrete player area. Each player area has a discrete betting area. Two classes of intermingled gaming chips are accepted in a stack in the discrete betting area. The gaming chip of the first class, comprising the primary wager, has a first transponder containing at least value information. The gaming chip of the second class, comprising the secondary wager, has a second transponder containing value and class information. A transceiver system located on the gaming table within the vicinity of the betting area is used to receive value signals from the first transponder and transponder value and class signals from the second transponder. These signals are conveyed to a computer system that then determines a primary wager value of the primary wager based on the value signals from the first transponder. The computer system also determines the secondary wager value as distinct from the primary wager value based on the value and class signals from the second transponder. Thus, the computer is provided with the respective wager values and the distinct class of the secondary wager when the primary wager and the secondary wager are intermingled within the discrete betting area. Similarly, U.S. Pat. No. 5,781,647 describes a computer implemented gambling chip recognition system having the ability to capture an image of a stack of gambling chips and automatically processing the image to determine the number of chips within the stack and the value of each. The system processor determines the classification for each chip in a stack by way of processing performed in real time on the image of the stack of gambling chips. The system further includes the ability to communicate the information derived from the stack of gambling chips to a video monitor and the ability to communicate the information to a main database where information is being compiled and stored about an individual gambler.

U.S. Pat. No. 5,735,742 also describes a chip-tracking system wherein a fully automated accounting system accurately and automatically monitors and records all gaming chip transactions in a casino. The system employs a gaming chip having a transponder embedded therein and has an ongoing and "on-command" ability to provide an instantaneous inventory of all of the gaming chips in the casino, including those in storage in the vault as well as the chips in the cashier's cage and at each gaming table on the casino floor. The system is capable of reporting the total value of the gaming chips at any location, as well as the value of any particular transaction at any gaming table or at the cashier's cage. Optionally, the transaction history of each chip may be maintained in a database embedded in the chip (or alternatively in a central computer), and read each time the gaming chip is scanned by a special antenna. If the chip is not where it is supposed to be according to its recorded transactional history (for example, a vault chip shows up on a gaming table without having passed through the cashiers cage), it will be identified and may be invalidated by nullifying a special casino security code. U.S. Pat. No. 5,651,548 describes a system whereby radio signals or RF responses from individual chips are tracked throughout a casino. U.S. Pat. No. 6,200,218 describes a chip-tracking system in trays on a casino table.

U.S. Pat. No. 6,183,362 describes a system and method for implementing a customer tracking and recognition program that encompasses customers' gaming and non-gaming activity alike at a plurality of affiliated casino properties. Customer information is accumulated at each affiliated casino through one or more LAN-based management systems, updated to a central patron database (CPDB) that is coupled to each casino LAN through a WAN, and made available to each affiliated casino property as needed. Customer accounts are automatically activated and provided with data from the CPDB when a customer from one casino property first visits an affiliated casino property. Customer accounts are updated with new activity data whenever a management system associated with the casino receives customer data from input devices, such as card readers, workstations, and dumb terminals, located at various venues throughout the casino. Customers are awarded points, based on their tracked activity at all affiliated casino properties. The point awards have a monetary value and are redeemable for gifts, meals, cash and the like, at any of the casino properties. The point awards may embody different promotional schemes in which point awards are adjusted to target different casino properties or different venues within a casino. Summary customer data, including point levels, is regularly updated to reflect ongoing customer activity at the casino property. This data is made available to employees at any affiliated casino property, as needed, to personalize customer services.

U.S. Pat. No. 6,165,069 describes a system and method for playing live casino type card games, in particular blackjack. The systems include a presentation unit that has video displays that portray virtual playing cards and other information at gaming tables attended by live participants. Shuffling, cutting, dealing and return of playing cards are accomplished using data processing functions within an electronic game processor or processors that enable these functions to be performed quickly and without manual manipulation of playing cards. The invention allows casinos to speed play and reduce the risk of cheating while maintaining the attractive ambiance of a live table game.

U.S. Pat. No. 6,154,131 describes a system of sensors to prevent cheating at a casino gaming table, where the sensors are strategically positioned about a casino gaming table to monitor the movement about certain established areas on the gaming table during certain established times during the play of the game. The tripping of a sensor in response to the detection of unauthorized movement about a certain area of the table sends a signal to a monitoring system, which, in turn, alerts the casino so that the casino may respond to the unauthorized movement accordingly. The system of sensors can be used with a wide variety of card-based or chip-based casino gaming tables.

U.S. Pat. No. 6,126,166 describes a system for monitoring play of a card game between a dealer and one or more players at a playing table, comprising: (a) a card-dispensing shoe comprising one or more active card-recognition sensors positioned to generate signals corresponding to transitions between substantially light background and dark pip areas as standard playing cards are dispensed from the card-dispensing shoe, without generating a bit-mapped image of each dispensed standard playing card; and (b) a signal processing subsystem adapted to: receive the transition signals generated by the active card-recognition sensors; determine, in real time and based on the transition signals, playing card values for the dispensed standard playing cards; and determine, in real time, a current table statistical advantage/disadvantage relative to the players for playing cards remaining in the card-dispensing shoe.

U.S. Pat. No. 6,093,103 describes a secure game table system, adapted for multiple sites under a central control, for monitoring each hand in a live card game. A common deck identity code is located on each card. A shuffler has a circuit for counting the cards from a previous hand that are inserted into the shuffler, and reading the common identity code. The game control verifies that no cards have been withdrawn from the hand by a player or that new cards have been substituted. A unique code also placed on each card is read as the card is dealt to indicate the value and the suit. The game control stores this information in a memory so that a history of each card dealt is recorded. Sensors are located near each of the player positions for sensing the presence of a game bet and a progressive bet. A card sensor located near each player position and the dealer position issues a signal for each card received. The game control receives these signals and correlates those player positions having placed a game and/or progressive bet with the received cards. The game control at each table has stored in memory the winning combinations necessary to win the progressive jackpots. Since the game control accurately stores the suit and value of each card received at a particular player position, the game control can automatically detect a winning progressive combination and issue an award signal for that player position.

U.S. Pat. No. 6,071,190 describes a gaming device security system that includes two processing areas linked together and communicates critical gaming functions. These functions are communicated via a security protocol wherein each transmitted gaming function includes a specific encrypted signature to be decoded and validated before being processed by either processing area. The two processing areas include a first processing area having a dynamic RAM and an open architecture design, which is expandable without interfering or accessing critical gaming functions, and a second "secure" processing area having a non-alterable memory for the storage of critical gaming functions therein. The gaming machine may comprise, in combination: a first processor having open architecture including internal alterable program storage media, a visual display coupled thereto visually accessible to a player and a communication interface; a second processor having a secure processing area and having means for retaining regulatory validation, a static, non-volatile random access memory, a non-alterable read only memory and means for sending encrypted communicating data to the first processor via the communication interface, the second processor having means for sensing wagering activity and means for transmitting a random gaming outcome to the first processor to be posted on the visual display, the second processor provided with means to bestow credits as a function of the random gaming outcome.

Many different card delivery shoes and shuffling devices have been disclosed in which card-reading capabilities are provided, and by intuition or estimation, hand-reading capability has been provided. An example of that type of apparatus is found in U.S. Pat. No. 6,039,650. That patent discloses a playing card dispensing shoe apparatus, system and method wherein the shoe has a card scanner that scans the indicia on a playing card as the card moves along and out of a chute of the shoe by operation of the dealer. The scanner comprises an optical-sensor used in combination with a neural network that is trained using error back-propagation to recognize the card suits and card values of the playing cards as they are moved past the scanner. The scanning process, in combination with a central processing unit (CPU), determines the progress of the play of the game and, by identifying card counting systems or basic playing strategies in use by the players of the game, provides means to limit or prevent casino losses and calculate the theoretical win of the casino, thus also providing an accurate quality method of the amount of comps to be given a particular player. The shoe is also provided with additional devices that make it simple and easy to access, record and display other data relevant to the play of the game. These include means for accommodating a "customer-tracking card" that reads each player's account information from a magnetic strip on the card, thus providing access to the player's customer data file stored on the casino's computer system and one or more alphanumeric keyboards and LCD displays used to enter and retrieve player and game information. Also included are keyboards on the game table so that each player can individually select various playing or wagering options using their own keyboard. U.S. Pat. No. 5,722,893 also describes a shuffler/shoe with card-reading capability.

U.S. Pat. No. 5,919,090 describes a method and apparatus for determining the win or loss of individual participants in a game of chance, such as, for example, blackjack, poker, or the like, wherein the bet and the winnings are represented by chips. A central chip depository is provided for receiving the game inventory and the latter has means for determining its momentary content. At least one chip deposit area is provided per participant and has in each case at least one sensor for the detection of chips lying on the deposit area. The means for determining the momentary chip content and also the sensors have their outputs connected to the inputs of a data processing system.

U.S. Pat. No. 5,613,912 describes a complex player-tracking system in which there is automatic tracking of the betting activity of casino patrons at gaming tables and providing an indication of this betting activity to casino personnel in real time. Casino patrons use magnetic cards to check themselves in and out of the bet-tracking system through magnetic card readers located at each betting position of a gaming table. Customer identity and location codes are coupled from the gaming table to a computer system using a wireless communication network. The computer system uses the codes to retrieve customer information, to estimate an average bet for the patron based on the current minimum table bet for the gaming table and the time period of the patron's play, and to calculate periodically an average theoretical win based on the patron's play. This information is made available through the casino computer system to casino personnel at the patron's gaming table and at any other gaming table to which the patron moves. The information available to the casino personnel is updated periodically to reflect the patron's accumulated betting activity. Similarly, U.S. Pat. No. 5,586,936 describes an automated gaming table tracking system for a gaming table, such as blackjack. A sensor located in the dealer's card playing area senses the start and end of each game. A unique player identity card is given to each player that contains information on the player. When a player arrives at a player position on the table, the player inserts his player identity card into a player station control at the player position. A central distribution control is connected to each player station control for determining the start and the end of each game and beginning and termination of play by each player at each position. A host computer is then interconnected to the central distribution control for storing the player identity information and the player position for each player station control, the start and end of each of the games, and the beginning and termination of play at each player position from the central distribution control. The host computer prints a player-tracking card. The floor supervisor observes the player during the game and fills out the in-session gaming information. Once the player leaves the table, the player-tracking card with the in-session gaming information filled out is then placed in an automatic reader so that the read in-session gaming information is stored in a data base corresponding to the identity of the player.

The LET IT RIDE BONUS® poker system is one commercial system that provides live table game security. The system includes a general-purpose game computer (typically shared by multiple tables), a programmable keypad computer and an intelligent card shuffler. Each computer component, however, has limited communication capacity among each other and the intelligence of the shuffler has been limited. A description of the components and their operation is provided below as an admission of prior art.

Keypad Computer and Controls: a player achieves a preselected winning bonus hand, the dealer inputs this information into a keypad controller. The keypad allows the dealer to start/end a game. The keypad controller receives signals from the side bet detectors (e.g., sensing that a side bet has been placed) and transmits the information to the central game computer. The keypad controls verify security keys. Physical "keys" are inserted by the dealer into the keypad controller as an extra security measure prior to paying a large payout. Often, the pit boss carries the keys and must physically verify the hand and payout before the key is used. The use of the "key" system allows verification of selected high-ranking bonus hands (i.e., a royal flush). When a winning bonus hand is achieved, the dealer inputs the position number of the winning hand into the keypad. The keypad computer verifies that an original bonus bet (side bet wager) was registered to that position. Chip sensors in the table area associated with the side bet wagers communicate with the keypad only. The keypad controls currently can communicate over fiber optic or copper cables to the game computer. The keypad computer can communicate with other hardware devices (such as a progressive meter, CRS (card revelation monitor system for display of symbols such as a card to be matched or indication of a wild card) system, with a random number generator or a sign. During setup, the keypad computer can be programmed for different games, pay tables, etc. During setup, the keypad computer is set to select music (on/off) that may indicate a bonus award. The keypad sends this information to the game computer, and the game computer controls the audio system.

Shuffler: The currently marketed technology permits the shuffler to communicate only with the keypad controller. The shuffler tells the keypad in real time how many cumulative hands have been dealt. Misdeal information is also transmitted from the shuffler to the keypad. The presence of the shuffler is verified by sending a signal to the keypad controller. The keypad controller continually polls for the presence of the shuffler. Once the presence of the shuffler is confirmed, control of some aspects of shuffler operation (such as when to deal cards) is taken over by the keypad controller. The keypad computer tells the shuffler when it is time to deal another round, and tells the shuffler when all bets have been placed and dealing can proceed.

General Purpose Game Computer: This computer is typically shared by multiple tables. It receives no information from the shuffler. It receives online/offline status of a game from the keypad controller. Key code information (to verify a high-ranking winning hand) is verified on the central computer. The central computer assembles reports of data, including the number of hands/bets/rounds (or games), game identification (that is, what game is being played on the shuffler), table identification (that is, which table is being used), bonus hands won, win/(unit time), hands/(unit time), and bets/(unit time).

Each of these areas of security and capabilities at casino gaming tables have been independently provided, or provided as grouped features. The failure to appreciate the interrelationship of some of these individual tasks and the failure to integrate them into a single piece of table game equipment has weakened the overall benefit to the casino.

SUMMARY OF THE INVENTION

A secure casino table gaming system and method of use that is designed to maximize casino security with regard to play of the table game comprises a multicomponent, multi-intelligence set of components that communicate in real time to assess the many facets of events that occur at a gaming table. The assessment provides evidence of the occurrence of significant events and provides a complete record of events in play at a table, significantly reducing the opportunity for individuals or groups to cheat at a gaming table without being observed.

At a minimum, at least two and preferably at least three microprocessors (computers, or other intelligent apparatus) are associated at a casino table with a card game. One microprocessor is specifically associated with a shuffling and/or randomizing/dealing apparatus (generally referred to herein as "shufflers" and, e.g., Bally Gaming, Inc.'s ACE®, Shuffle Master, Inc.'s KING™, and other newly developed shufflers) to provide real time information including at least some of (and preferably all of) the number of cards that have been shuffled, the authenticity of cards in the shuffler, the number of times that a shuffling sequence of complete shuffle has been performed, the rank and value of specific cards being fed out of a section of the shuffler, the number of cards in the shoe (the delivery section of a shuffler), the rank of specific hands provided to each player, and the like.

Another microprocessor and/or game computer is directed toward game control function and is referred to herein as the table game controller or table game microprocessor. The table game controller identifies game functions and preferably includes some or all of wager amounts (provided by detectors, such as weight sensitive detectors, scanning detectors, manual input, proximity detectors, RF reading from embedded signaling systems, etc.), entry and/or recognition of side bet wagers, amounts wagered on side bets (e.g., from detectors), presence of a player at specific positions, identity of a player at specific locations (from a player-tracking system), wagering activity at a position, results of each game (based on information fed to it from the shuffler microprocessor or from a table scanner), the frequency of wins at specific positions, the frequency of bonus or jackpot events, and the like.

The third possible microprocessor (or the functions that must be combined in the performance of one or both of the other microprocessor already described) include player identification, dealer identification, betting pattern recognition software, betting pattern recordation, win/loss records and real time tallies, time of play and play rates and wagering rates, table identification, game histories, play histories, play versus time of day data, replacement times of dealers, replacement times and status of shufflers, and the like. This information can be compared and evaluated in real time, with real time communication among all of the microprocessors, to signal the occurrence of unusual events, track players, track dealers, track margins at tables, and identify a whole range of events that are desirable in maintaining casino security.

DETAILED DESCRIPTION OF THE INVENTION

Figure 1:
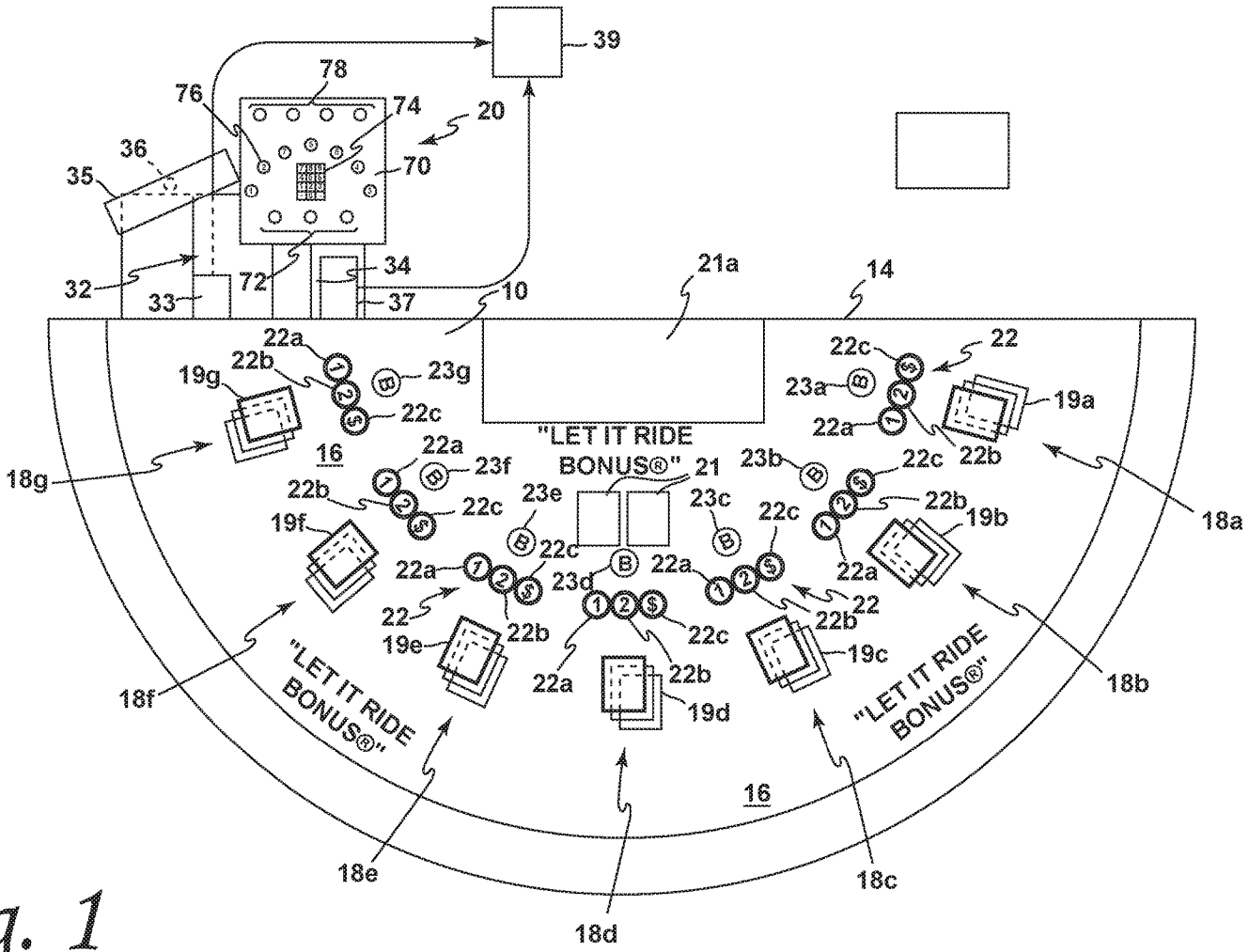
FIG. 1 shows a casino card gaming table configured to play LET IT RIDE BONUS® stud poker according to one aspect of the present invention.
Figure 2:
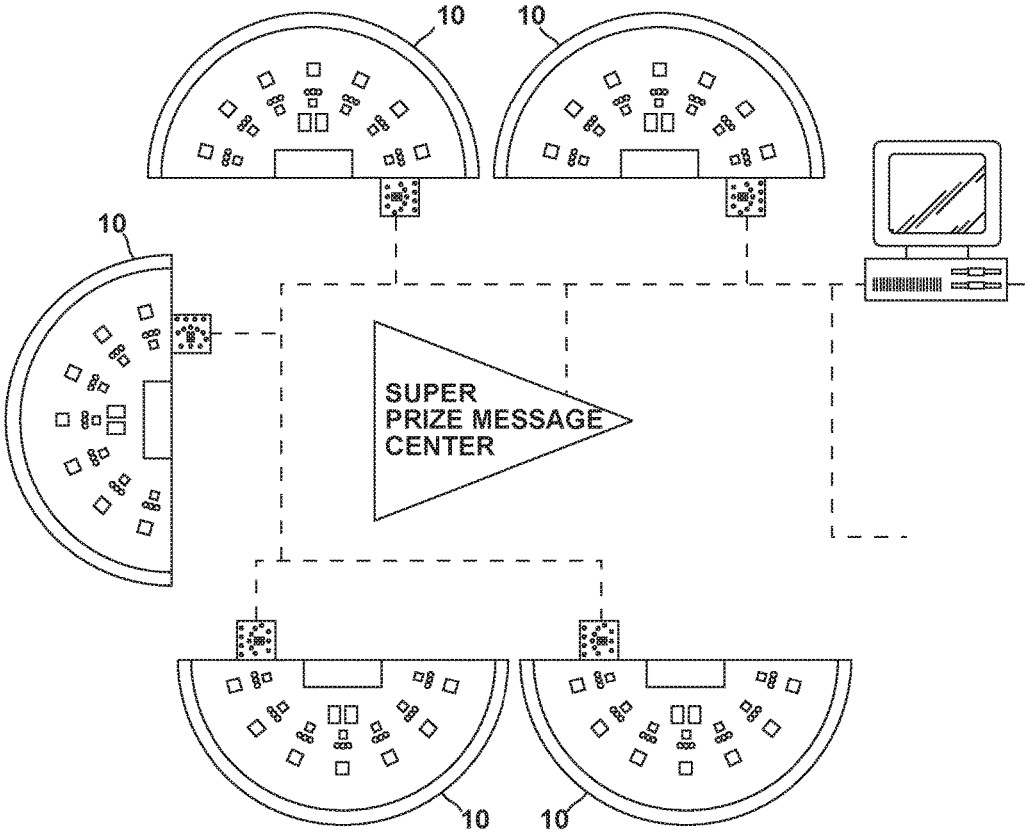
FIG. 2 shows a series of casino card gaming tables configured to play LET IT RIDE BONUS® stud poker and communicating with a single central computer according to one aspect of the present invention.
Figure 3:
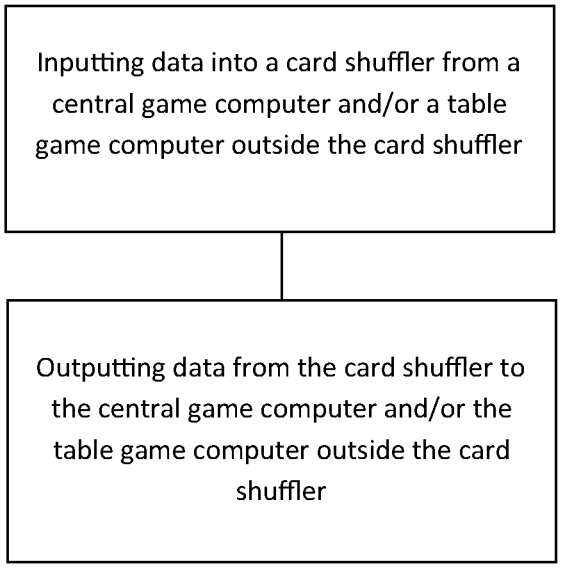
FIG. 3 shows a flowchart in accordance with an embodiment of the disclosure.

The card table game monitoring and security apparatus of the present invention comprises at least two distinct computers, preferably at least three computers associated with specific elements and communicating in real time. The system of the present invention includes a main table game controller, and will have a shuffler with its own intelligence and a keypad without its own intelligence, communicating directly with a main table game controller and possibly other table game controllers. The table game controller communicates with a main controller. The main controller is a general purpose computer and collects data from a group of game tables and/or groups of games and their tables in real time. In one form of the invention, the table game controllers share information and are in direct communication, or communication through the central controller. Typically, multiple table games of the same or of a different type are connected to the main controller. The main controller in the practice of this invention receives data from each of the table controllers, including player tracking, betting information, card identification, dealer information, player information, table location, and on a progressive system, the shared progressive amount.

The system and its use may be variously and generally described as a method of controlling a live casino table card game; comprising: sensing wagers by players at at least two player locations and communicating the sensing to a table game control computer in real time and communicating the sensing to a central control computer in real time; controlling an automatic card-shuffling device with a microprocessor in the card-shuffling device and communicating information relating to card shuffling to the game table controller computer in real time and to the central control computer in real time; and electronically measuring betting information and transmitting information to the central game controller computer in real time, the electronic measuring including use of data transmitted to the central game controller computer from the table game controller computer and the shuffler.

Alternative general descriptions include a method of controlling a live casino table card game; comprising: providing a live gaming table with at least two player locations and at least one sensor in each player location for sensing bets; providing a computer controlled automatic card-shuffling device; providing a table game controller; and providing a central game controller; electronically measuring betting information, wherein the card-shuffling device receives game related data from and/or transmits data to the table game controller in real time and wherein the table game controller transmits and/or receives game related information in real time to and/or from the central game controller.

Another aspect of the invention includes an automatic card shuffler, comprising: a programmable controller, a card-randomizing mechanism and a data port, wherein data is fed from outside the card shuffler via the data port into the programmable controller from a central game computer and/or table game computer, and/or data collected by the controller is fed outside the card shuffler via the data port to a central game computer and/or table game computer.

A still further aspect of the invention is a security system for a casino table card game comprising: a) a casino table with i) indicia thereon for the placement of wagers, ii) a data entry system with an associated computer, and iii) sensors that can detect the placement of at least one specific category of wager; b) a shuffling device with a microprocessor integral to the shuffler for providing information regarding cards or hands; c) a central table gaming computer that receives information from the shuffler in real time, receives information from the sensors, and receives information from the data entry system, the associated computer, the microprocessor and the central table gaming computer communicating data among each other in real time.

The table controller will allow tracking of at least the dealer identification, the dealer efficiency and/or productivity, table usage/idle time, table location and identification, dealer errors/cheating, chip tray accounting, multi-denomination betting tracking, universal (multiple different games) progressive table games, player activity, player strategy, player win/loss activity, card counting activity, player identification (although this can be specifically performed by the main controller, as may some of the other activities, even at this stage of development), etc.

Examples of the types of data that can be captured with this system include:

- Hands dealt per unit time.
- Identification of when a service call should be made.
- Automatic service call generation.
- Jam detection/recovery and reports of jams/clears in real time to main controller.
- Rounds of play/unit time.
- When cards are scanned for rank/suit, the value of the hand can be automatically ranked and the payout can be displayed, eliminating dealer errors.
- When cards are scanned for rank/suit and the correct payout is displayed, reports of dealer error/cheating are generated when wrong payouts are made.
- The signal from the bet sensors may be input into the shuffler itself to enable the shuffler to deal only the number of hands needed to cover the bets, speeding play of the game.
- The signal from the bet sensors can be transmitted directly to the central controller to collect betting data.
- The table controller will communicate with the player-tracking system, permitting the system to measure player bets placed, player efficiency (how far the player deviates from "optimal" strategy), time at the table, frequency of visiting property, etc.
- The table controller will continually poll the chip tray to verify that the correct number of chips is in the tray. Count of chips on the table can also be determined by sensors and included in the total count. Balances are fed to the central computer in real-time so that errors in paying are detected immediately.
- Data on the amount of time the table is in use, the time of day the table is in use, the table ID number, the table location, the times when the tables are most filled and the times when the most bets are made may be collected by the table controller and transmitted to the central controller so that management can optimize usage of personnel, the arrangement of equipment and choice of games/equipment. Management can determine when table should remain open, and when it should be closed.
- Data on a hand pitched game vs. the same game dealt through an automatic shuffler (at equivalent locations in terms of table usage/minimum and maximum bets, etc.) can be compared to measure productivity improvements gained through automating a table or automating the shuffling process.
- Dealer identification number or name may be input into the table controller at the beginning of a shift. The dealer can be asked to sign out at the end of shift, resulting in verification of hours worked and associated data collected during this period of time with a particular dealer. Data can be used to detect dealer cheating, dealer training needs and for implementing dealer recognition awards and special compensation for rewarding and/or recognizing exceptionally good dealers that are reflected in higher holds and longer retention at the table.
- An identification number corresponding to the shuffler can be inputted into the table controller to track the location of each shuffler. This ID information can also be transmitted to the main controller directly from the shuffler or into the table computer and then to the main controller.
- Reports on shuffler swap outs (replacements when performance of a shuffler is less than optimal) can be generated, to assist service personnel in servicing the right shufflers, and to improve the chances that back-up units are in working order.
- The central controller will generate reports such as rounds of play/shift, the number of players/shift, the average amount of time spent at the table/player, the handle, player reports that assist management in determining rating of a player, analysis/reports to use for player comping, etc.
- The table controller can be programmed so that it will alert the dealer and pit boss via the central controller that a card counter is playing on the table. When the system is reading the rank and value of each card, the table controller will know the count of each hand. If player bets increase when the shoe is rich in ten value cards, the system will alert the dealer and management that the player is counting cards.
- Data collected at each table controller can be transmitted in real time to the central controller, allowing management to thwart card counting, cheating schemes, dealer mistakes, etc., as the events occur.

In FIG. 1, is set forth a system of the present invention for a game table 10 on which a live card game is played. The system of the present invention can be applied to any of the following conventional game tables: baccarat and variants such as grand baccarat, mini baccarat, midi baccarat, baccarat, chemin de fer and puncto banco; blackjack and variants such as progressive twenty-one, triple-action blackjack, super seven's blackjack, Spanish twenty-one, vingt et un and pontoon; big wheel, big six and variants, craps and variants, in between and variants such as red dog and catch-a-wave; poker and variants such as CARIBBEAN STUD POKER™, Caribbean draw poker, LET IT RIDE® poker, tres card poker, pai gow poker, and wheel and deal; roulette and variants such as American roulette, THREE CARD POKER®, French roulette, single zero roulette and twin roulette; and sic bo. The form, type, and variation of the game on table 10 is immaterial to the teachings of the present invention and does not limit the teachings contained herein.

The game table 10, in one general exemplary embodiment, is adapted for LET IT RIDE BONUS® stud poker and, in FIG. 1, seven player positions 18*a* through 18*g* are shown. At each player position 18*a* through 18*g* is a card position 19*a* through 19*g*, respectively, and three individual player betting positions 22*a*, 22*b* and 22*c*. A side bet (e.g., jackpot or bonus) wagering position 23*a* through 23*g* is shown at each player position 18*a* through 18*g*. A position for the dealer's cards 21 is shown in front of the dealer's position 21*a*.

A card-shuffling or card-randomizing device 32 is provided on, next to or beneath the upper surface of the table 10. The shuffling device 32 preferably has its own separate computer/microprocessor 33 integral with or electronically associated with the shuffling device 32. The table computer 37 or controller controls the operations of the shuffling device 32 in another example of the invention. A card delivery shoe 35 is shown, from which shuffled cards, randomized cards, randomized hands or shuffled hands (not shown) are provided to the dealer to distribute. A card reader sensor 36, as indicated by dashed line, is shown within the card delivery shoe 35, although it may be positioned elsewhere within the card-shuffling or card-randomizing device 32, as is well known in the art. A sensor or sensors (not shown) may also be positioned on the table 10 so that cards are read and information provided to one of the computers (33, 37 and 39, or as later identified) to provide information for analysis. The game or table computer 37 or game controller is associated with a keypad system 20. The keypad system 20 includes a housing 70 bearing a keypad 74 (supported by attaching element 34 to the table 10) for entering data, various rows of buttons 72 and 78 for inputting data, and player position indicator buttons 76 for assigning data input to specific player positions (although other identification systems for individual player positions are within the choice of the ordinarily skilled artisan). The side bet wagering positions 23*a* through 23*g* are provided with sensing or counting bet detection devices B at the side bet wagering positions 23*a* through 23*g*. In a preferred form of the invention, the base game bet sensors located at player betting positions 22*a*, 22*b*, 22*c* are also equipped with electronic bet sensors and/or counting systems.

The bet detection devices B (as well as the devices located at player betting positions 22*a*, 22*b* and 22*c*) may be any sensing system such as, but not limited to a proximity detector, magnetic card reader, photo-optic or acoustic detector, RF responsive indicator/sensor, optical scanner, weight sensing device or the multiple security system described in U.S. Pat. No. 6,254,002. The card reader sensor 36 is shown to be located in the shuffling device 32 of FIG. 1 on the game table 10, but could also be located on the surface 16 of the table 10 or any suitable location including in the card delivery shoe 35 of the shuffling device 32, inside the shuffling device 32 when cards are moved one at a time within the shuffling device 32, or in any other strategic location near the gaming table 10.

Any commercially available card reader, especially those adapted for the gaming industry, could be utilized under the teachings of the present invention to read player data, available credit and any other information carried on player-tracking cards. Each card reader may form part of an array of card readers that are responsible for the collection of programmed data present on a card-based magnetic strip or in reading the images or other data on the cards. The present invention is not limited to magnetic or bar code card readers and it is to be expressly understood that the card utilized could be a smart card and that the device could write data into a smart card. Furthermore, any equivalent device could be utilized under the present invention, which at least reads player identification data from a data medium carried by the player.

The table computer 37 serves as an intelligent processor and communications hub for the game table 10. The table computer 37 contains software and coordinates all recognition, display, mathematical, diagnostic and communication routines and functions associated with the transfer of data between itself and the other table-based and distal components as will be explained in the following. The table computer 37 also interfaces with computer-based systems (e.g., computer/microprocessor 33 and computer 39) remote from the game table 10, and in one example of the invention, also communicates with other table-based computers on the property, or between properties via a network connection.

In FIG. 1 is also a dealer's keypad system 20 at dealer location 14 that serves as a communication device between the dealer and the system of the present invention. It enables the dealer to enter commands and/or selections of commands from predefined menus. Also at the dealer location 14 may be a dealer visual interface (not shown, may be located on the table 10 or on the shuffling device 32) that displays game information, chip tray inventories, personnel identification, casino chip values, and values summed by player positions 18*a* through 18*g*. In addition, component status and/or miscellaneous messages from the computers 33, 37 and 39 and/or remote computer-based systems can be displayed.

In the practice of the present invention, commercial components and subcomponents may be used to build the architecture of the system. For example, in use and operation, the invention may include processor boards, intelligent boards, unintelligent boards, a main board, microprocessors, a graphics system processor, an audio processor, the boards and components including memory in the form of ROM, RAM, Flash memory, EPROM, NVRAM and/or EEPROM (electrically erasable programmable read only memory). The central gaming control computer or the table game controller computer may include a system event controller, the random number generator, a win decoder/pay table, status indicators, a communications handler, encryption system for signals, hardware and peripherals (e.g., lights, displays, buttons, coin acceptors, key switches, doors switches, change systems, credit validators, play reporting systems, currency validators, hopper controls, diverters, lamps, auxiliary outputs, printers, handles, magnetic strip readers, optical scanners, credit card scanners, joy sticks, touchpads, light wands, signal systems, and other active or interactive controls). Software may be provided with any operating system, either proprietary, public, open key or closed key such as the many variations of WINDOWS® operating systems, MAC® operating systems (e.g., MAC® OS), LINUX®, UNIX®, and the like.

The displays used on the various components may be in the form of monitors (i.e., CRT displays), plasma screens, light emitting diode (LED) panels, semiconductor displays, liquid crystal displays, and the like.

The description above is to be considered examples of the invention, and is not intended to limit the spirit or scope of the invention.

What is claimed is:

1. An automatic card shuffler, comprising:

a programmable controller contained in the automatic card shuffler;

a shuffling feature for randomizing cards; and a data port in communication with the programmable controller configured to input data including data from bet sensors into the automatic card shuffler from a central game computer and/or a table game computer outside the automatic card shuffler and configured to output data from the programmable controller to the central game computer and/or the table game computer outside the automatic card shuffler, the programmable controller configured, in response to the data received from the bet sensors, to automatically instruct the card shuffler, without any user intervention, to deal a selected number of hands from the card shuffler, the selected number of hands corresponding to the data from the bet sensors.

2. The automatic card shuffler of claim 1, wherein the programmable controller is programmed for input and output of data in real time.

3. The automatic card shuffler of claim 1, wherein the programmable controller is configured to output data collected by the programmable controller including information regarding at least one of a rank or a value of at least one card to at least one of the table game computer or the central computer.

4. The automatic card shuffler of claim 1, wherein the programmable controller is configured to instruct the instruct the card shuffler to deal a selected number of hands from the card shuffler based on a number of the wagers received from players provided in the data from at least one bet sensor.

5. A card shuffler, comprising:

a card shuffling device configured to randomize cards; and a programmable controller configured to:

receive data from at least one of a central game computer separate from the card shuffler or a table game computer separate from the card shuffler;

receive signals from bet sensors indicating placement of wagers by players; and in response to the signals received from the bet sensors, automatically instruct the card shuffler to deal a selected number of hands from the card shuffler, the selected number of hands corresponding to a number of the wagers received from the players.

6. The card shuffler of claim 5, further comprising a data port in communication with the programmable controller, the programmable controller configured to at least one of send data or receive data via the data port.

7. The card shuffler of claim 5, wherein the programmable controller is configured to instruct the card shuffler to automatically provide the selected number of cards dealt from the card shuffler as a selected number of complete hands.

8. The card shuffler of claim 7, wherein the programmable controller is configured to instruct the card shuffler to provide the selected number of hands based on at least one bet sensed by the at least one bet sensor.

9. The card shuffler of claim 5, wherein the programmable controller is configured to send an identification number corresponding to the card shuffler to the at least one of the central game computer or the table game computer.

10. The card shuffler of claim 5, wherein the programmable controller is configured to send at least one indication of a jam of a shuffling event to the at least one of the central game computer or the table game computer.

11. The card shuffler of claim 5, further comprising at least one sensor configured to read at least one indicia of at least one card in the card shuffler.

12. The card shuffler of claim 11, wherein the programmable controller is configured to send data relating to the at least one indicia of the at least one card to the at least one of the central game computer or the table game computer.

13. The card shuffler of claim 5, wherein the programmable controller is configured to receive a signal from a key pad system operated by an administrator of a gaming device relating to at least one player at the gaming device.

14. A card shuffler, comprising:

a card rearranger;

at least one sensor configured to sense at least one card in the card shuffler; and a programmable controller configured to:

send data from the card shuffler relating to the at least one card to an external device comprising at least one of a central game computer or a table game computer;

receive data into the card shuffler relating to at least one wager placed in a wagering game from the external device comprising the at least one of the central game computer or the table game computer; and in response to the data relating to the at least one wager placed in the wagering game, directly instruct the card shuffler to deal a selected number of hands from the card shuffler, the selected number of hands corresponding to a number of the wagers received in the wagering game.

15. The card shuffler of claim 14, wherein the programmable controller is configured to send at least one indication of a total number of cards in the card shuffler to the at least one of the central game computer or the table game computer.

16. The card shuffler of claim 14, wherein the programmable controller is configured to send at least one indication of a number of hands dealt to active players to the at least one of the central game computer or the table game computer.

17. The card shuffler of claim 14, wherein the programmable controller is configured to send at least one indication of a rank of at least one specific hand dealt by the card shuffler to the at least one of the central game computer or the table game computer.

18. The card shuffler of claim 14, wherein the programmable controller is configured to send at least one indication of an excess of cards of specific rank and suit to the at least one of the central game computer or the table game computer.

19. The card shuffler of claim 14, wherein the programmable controller is configured to send at least one indication of at least one hand achieving a bonus to the at least one of the central game computer or the table game computer.

* * * * *